US009105260B1

(12) United States Patent
Helms et al.

(10) Patent No.: US 9,105,260 B1
(45) Date of Patent: Aug. 11, 2015

(54) GRID-EDITING OF A LIVE-PLAYED ARPEGGIO

(71) Applicant: APPLE INC., Cupertino, CA (US)

(72) Inventors: Jan-Hinnerk Helms, Hamburg (DE); Markus Sapp, Appen-Etz (DE); Thomas Sauer, Rellingen (DE)

(73) Assignee: Apple Inc., Cupertino, CA (US)

( * ) Notice: Subject to any disclaimer, the term of this patent is extended or adjusted under 35 U.S.C. 154(b) by 6 days.

(21) Appl. No.: 14/254,489

(22) Filed: Apr. 16, 2014

(51) Int. Cl.
*G10H 1/28* (2006.01)
*G10H 1/36* (2006.01)
*G10H 1/38* (2006.01)

(52) U.S. Cl.
CPC . *G10H 1/28* (2013.01); *G10H 1/36* (2013.01); *G10H 1/386* (2013.01); *G10H 2210/185* (2013.01)

(58) Field of Classification Search
IPC ..... G10H 1/28,2210/185, 1/36, 1/386
See application file for complete search history.

(56) References Cited

U.S. PATENT DOCUMENTS 3,617,602 A * 11/1971 Kniepkamp ..... 84/716
3,718,748 A * 2/1973 Bunger ..... 84/716
3,842,182 A * 10/1974 Bunger ..... 84/716
3,842,184 A * 10/1974 Kniepkamp et al. ..... 84/655
4,154,131 A * 5/1979 Studer et al. ..... 84/638
4,156,379 A * 5/1979 Studer ..... 84/638
4,179,970 A * 12/1979 Faulkner ..... 84/716
4,182,212 A * 1/1980 Sigeki ..... 84/716
4,185,530 A * 1/1980 Robinson et al. ..... 84/704
4,187,756 A * 2/1980 Robinson et al. ..... 84/655
4,191,081 A * 3/1980 Deutsch et al. ..... 84/669
4,881,440 A * 11/1989 Kakizaki ..... 84/609
4,926,737 A * 5/1990 Minamitaka ..... 84/611
5,973,253 A * 10/1999 Hirata ..... 84/609
6,051,771 A * 4/2000 Iizuka ..... 84/622
2005/0016366 A1* 1/2005 Ito et al. ..... 84/716
2008/0072744 A1* 3/2008 Ito et al. ..... 84/638
2015/0013532 A1* 1/2015 Adam et al. ..... 84/638

* cited by examiner

*Primary Examiner* — David Warren
(74) *Attorney, Agent, or Firm* — Kilpatrick Townsend & Stockton LLP

(57) ABSTRACT

A method including receiving a first set of performance data corresponding to a first plurality of MIDI-based notes in a first rhythmic order. The first plurality of MIDI-based notes may form a first arpeggio, with each of the first plurality of notes having a corresponding first performance data. The method further includes receiving input data indicating a change to the first performance data corresponding to a note in the first plurality of notes, changing the first performance data for the corresponding note using the input data, receiving a second set of performance data corresponding to a second plurality of MIDI-based notes, and applying the changed first performance data to the second performance data. Applying the first changed performance data includes editing the second set of performance data in real-time by replacing the second performance data with the changed first performance data.

20 Claims, 16 Drawing Sheets

GRID-EDITING OF A LIVE-PLAYED ARPEGGIO

BACKGROUND

Virtual musical instruments, such as MIDI-based or software-based keyboards, guitars, basses, and the like, are ubiquitous in contemporary music across many different genres. Virtual instruments allow a user to play virtually any sound that a typical acoustic instrument could play and much more. Amateur musicians with little to no experience on a particular instrument or with music composition may find that virtual instruments are more intuitive and can provide simplified ways of creating music without needing the manual dexterity or knowledge of music theory that a conventional instrument may require.

Software-based music production tools can be used to create many different genres of music and provide resources that can allow a user to quickly and easily create musical compositions without the need for any appreciable proficiency at a particular instrument. For example, musical passages can be created in real-time, in a methodical stepwise fashion, or a combination thereof. Notes, chords, melodies, and harmonies can be created, and in some cases, the software can provide shortcuts that can make producing music even easier without the need for understanding its theoretical underpinnings. For example, music production software may help a user create a chord progression with diatonic harmony without requiring the user to understand the theory of the chord sequence. As a result, software-based music production tools have become ubiquitous across many genres of music. Although this document refers to music production tools generally as digital audio workstations (DAWs)(e.g., Logic Pro™), it should be understood that any suitable production tool can implement the concepts and embodiments described herein and can additionally include, but are not limited to, software sequencers, synthesizers, drum machines, Musical Instrument Digital Interface (MIDI) keyboard workstations, software plug-ins, and the like.

One type of musical technique that conventionally requires some proficiency is the arpeggio. An arpeggio involves the playing or sounding notes of a chord in a sequence, rather than playing them simultaneously. For example, a C major chord comprises the notes of C, E, and G. One example of a C major arpeggio may involve playing the notes of C, E, G, E, and C in succession, one after the other. This technique can become physically challenging to perform when played with fast tempos, large octave ranges, complex chord structures, difficult chord changes, or the like. Thus, many systems incorporate features to automate the performance of arpeggios and help create musical sequences and progressions that could not otherwise be played by those lacking in musical proficiency. An arpeggiator can streamline the process of creating an arpeggio by automatically stepping through a sequence of notes based on an input (e.g., chord). An arpeggiator is a feature typically available on synthesizers, digital audio workstations (DAW), software sequencers, or other music creation programs or tools that can automatically step through a sequence of notes based on an input (e.g., chord) to create an arpeggio. The notes can often be transmitted to a MIDI sequencer for recording and editing. An arpeggiator typically can control the speed, range, and order in which the notes play, including patterns trending upwards, downwards, or randomly. More contemporary arpeggiators allow the user to step through a pre-programmed complex sequence of notes, or even play several arpeggios at once.

Although arpeggiators can be a highly useful and powerful creative tool, many users find that conventional arpeggiators are difficult or cumbersome to use, they are limited in their application, or require extensive tinkering to generate a harmonically pleasing and useful sequence. These problems lead to frustration and make arpeggiators less useful for many practical applications. Therefore, a need exists for an arpeggiator that can be applied to a broad spectrum of applications in a seamless, intuitive, and musically inspiring way.

DETAILED DESCRIPTION

Figure 1A:
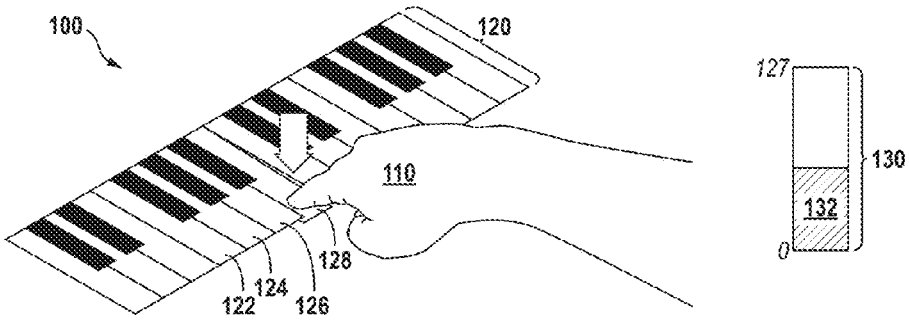
FIG. 1A illustrates aspects of musical performance data including velocity characteristics, according to certain embodiments of the invention.

Embodiments of the invention generally relate to software configured for generating, recording, editing, and producing musical performances. More specifically, embodiments of the invention relate to real-time editing of an arpeggio in a musical performance.

Real-time editing of live-played arpeggios allows a user to physically play an arpeggio (or build one in a step-wise fashion) and capture aspects of the performance in a grid-type interface. Certain aspects of the arpeggio performance (i.e., performance data) include the velocity of the notes, the type of note (e.g., rest, note, tie), and the rhythmic order of the arpeggiated notes. The captured arpeggio performance data can then be applied to subsequent chords in real-time to automatically create new arpeggio sequences based on the captured performance data. The user can further edit the performance data (e.g., change velocity data) in real-time after the performance is captured, while simultaneously creating, playing, and altering arpeggiated performances during a live performance.

In some embodiments, a method includes receiving a first set of performance data corresponding to a first plurality of MIDI-based notes in a first rhythmic order. The first plurality of MIDI-based notes may form a first arpeggio, with each of the first plurality of notes having a corresponding first performance data. The method further includes receiving input data indicating a change to the first performance data corresponding to a note in the first plurality of notes, changing the first performance data for the corresponding note using the input data, receiving a second set of performance data corresponding to a second plurality of MIDI-based notes, and applying the changed first performance data to the second performance data. Applying the first changed performance data includes editing the second set of performance data in real-time by replacing the second performance data with the changed first performance data. In some embodiments, note data can be received and can include pitch, velocity, note characteristics (rest, tie, etc.), tone, other other aural characteristics, all of which can be edited using the grid-editing capabilities described herein. Although the various embodiments described herein tend to focus on editing note velocities and identifiers (e.g., note, tie, rest), it would be appreciated by one of ordinary skill in the art with the benefit of this disclosure that incorporating other parameters in grid-editing implementations are possible.

Musical Performance Data

Musical performance data can include any number of performance characteristics that define how a musical element is played (or not played) in an arpeggio. For example, musical performance data can include velocity data, note data (e.g., note type, rest type, note ties, etc.), rhythmic order data, timing data, pitch data, or any type of data that can characterize aspects of the performance, as would be appreciated by one of ordinary skill in the art with the benefit of this disclosure.

Velocity is one type of musical performance data that can be described as the speed or force with which the key is being hit. In a MIDI input device (e.g., keyboard), the harder a key is played, the higher the velocity value is registered. Similarly, the softer the key is played, the lower the velocity value. In MIDI, velocity is typically measured on a scale from 0 to 127, with 127 being the highest value that can be registered. It would be understood by one of ordinary skill in the art that any range of values, MIDI or otherwise, can be used to represent key velocity values.

FIG. 1A illustrates aspects of musical performance data 100, according to certain embodiments of the invention. FIG. 1A includes a keyboard 120 (e.g., MIDI keyboard) with keys 122, 124, 126, and 128. A user 110 is depressing key 128 at a low velocity. The velocity bar 130 indicates a velocity of 35 out of 127, which is a relatively low velocity (i.e., a soft key press).

Figure 1B:
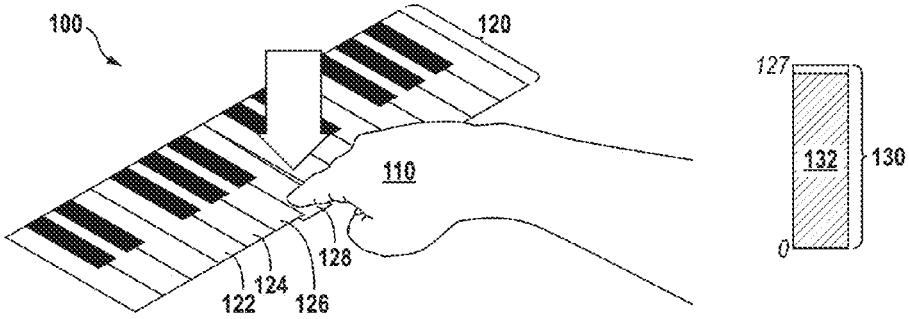
FIG. 1B illustrates aspects of musical performance data including velocity characteristics, according to certain embodiments of the invention.

FIG. 1B illustrates aspects of musical performance data, according to certain embodiments of the invention. FIG. 1B includes a keyboard 120 (e.g., MIDI keyboard) with keys 122, 124, 126, and 128. A user 110 is depressing key 128 at a high velocity. The velocity bar 130 indicates a velocity of 120 out of 127, which is a relatively high velocity (i.e., a hard key press). Although FIGS. 1A and 1B depict a user depressing key 122/128 at a certain velocity, key presses can be automated and may include any velocity, predetermined, real-time generated, and the like.

Figure 2:
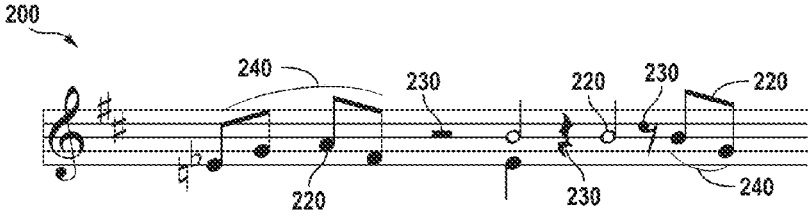
FIG. 2 illustrates aspects of musical performance data including notes, rests, and note ties, according to certain embodiments of the invention.

Note data is another type of musical performance data that can be described or identified as one of a note, a rest, or a tie. Notes can include quarter notes, half notes, whole notes, or other note intervals, and any such arrangement or grouping, etc., is possible. A rest is an interval of silence in a piece of music, marked by a symbol indicating the length of the pause and, like notes, may be of any desired duration. A tie is represented by a curved line that connects the heads of two notes of the same pitch and name, indicating that they are to be played as a single note with a duration equal to the sum of the individual notes' note values. For example, a whole note may span over two measures and be noted with a tie to show that the note sustains during that time. Notes, rests, and ties, and their respective uses and applications would be understood by one of ordinary skill in the art. FIG. 2 illustrates aspects of musical performance data, according to certain embodiments of the invention. Measure 200 includes a number of musical elements including a sequence of notes 220, rests 230, and ties 240 that group certain notes together.

Figure 3:
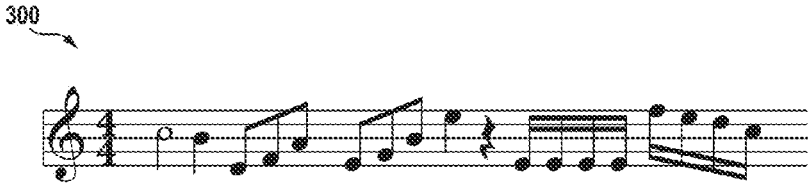
FIG. 3 illustrates aspects of musical performance data including rhythmic timing, according to certain embodiments of the invention.

Rhythmic order data is musical performance data that refers to the order in which notes are received. Timing data, which can be a part of rhythmic order data, is musical performance data that refers to the timing of the sequence of, e.g., notes or rests, in a musical passage. FIG. 3 illustrates aspects of musical performance data including rhythmic data and timing data, according to certain embodiments of the invention.

Grid-Edit Arpeggiator Interface

Figure 4:
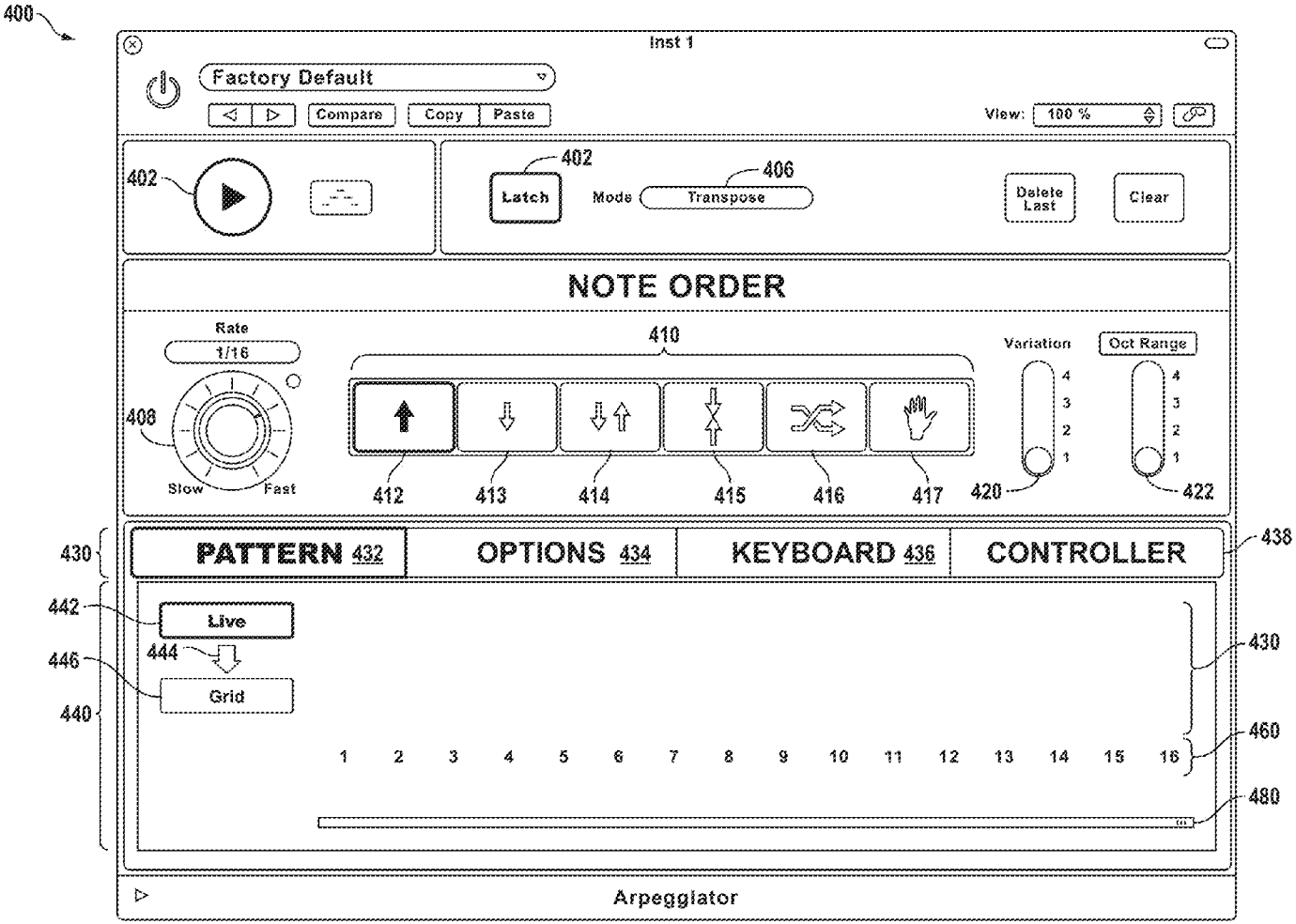
FIG. 4 is a simplified diagram illustrating aspects of an arpeggiator interface, according to certain embodiments of the invention.

FIG. 4 is a simplified diagram illustrating aspects of a graphical user interface (Arp GUI) 400 for an arpeggiator, according to certain embodiments of the invention. Arp GUI 400 includes a start/stop button 402, latch 404, mode selector 406, rate control 408, note order selector 410, variation control 420, octave range selector 422, control tabs 430 comprising pattern control 432, options control 434, keyboard control 436, and controller options 438, and edit field 440. Note order selector 410 includes up button 412, down button 413, up/down button 414, in button 415, random button 416, and free play button 417. Edit field 440 includes live mode 442, grid mode 446, and grid-capture button 444, note velocity region 450, note position region 460, and arpeggio progress bar 480.

Figure 21:
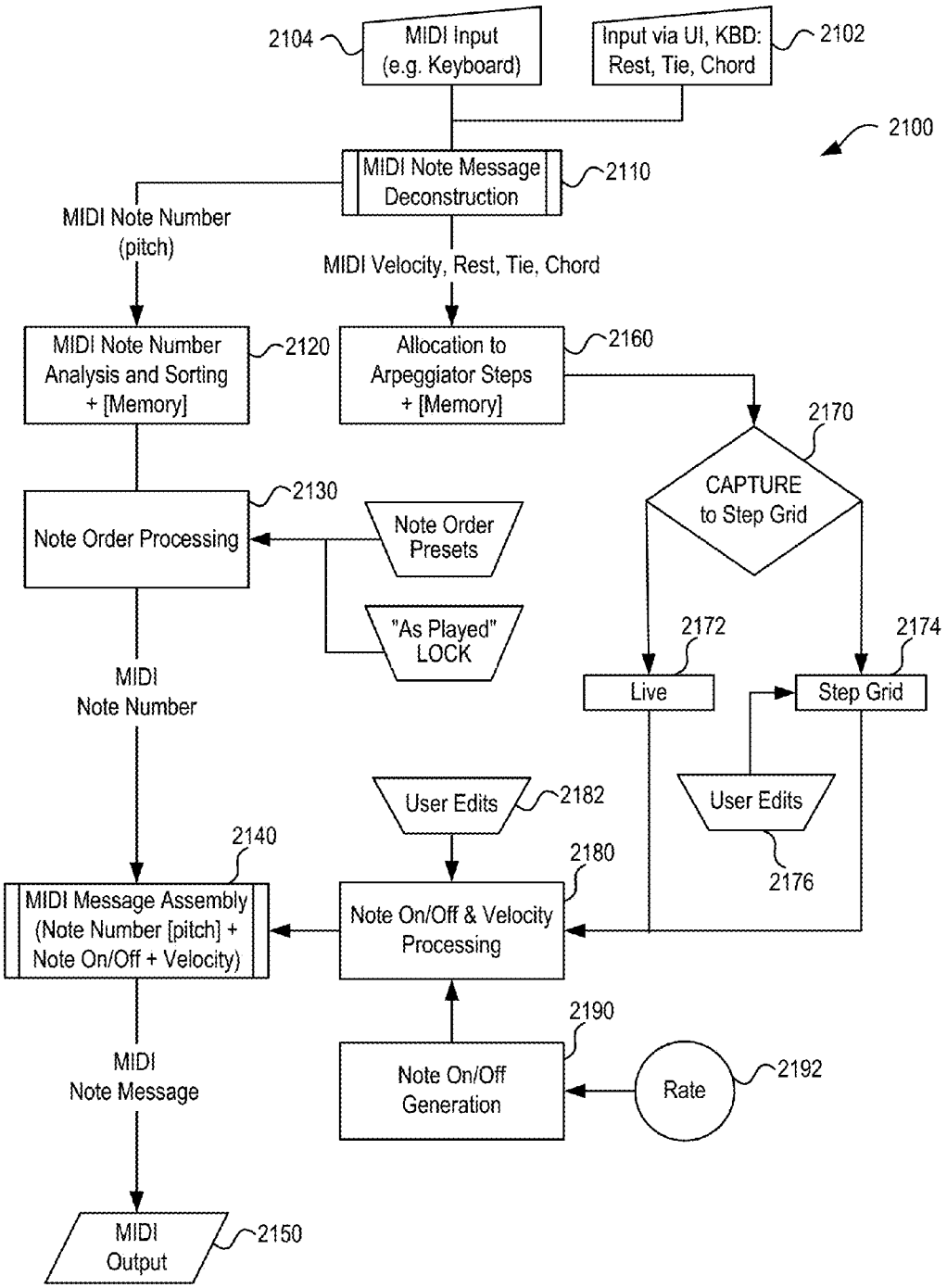
FIG. 21 is a high level flow diagram illustrating aspects of a system for operating an arpeggiator, according to certain embodiments of the invention.

Start/stop button 402 starts and stops an arpeggio generated by the arpeggiator. Latch button 404 is configured to "latch" notes (or rests) to create arpeggios of any desired length, e.g., in a live setting. With latch button 404 selected, notes can be individually added by a user (or by automation) to create an arpeggio of any desired length without having to physically play every note of the arpeggio at the same time. For example, a user can play 4 notes with her left hand and four notes with her right hand for a total of eight notes being played and shown in grid-edit field 440. With latch button 404 selected, the 8 notes remain "in play," similar to a sustain pedal on a piano, allowing the user to release the keys and add more notes if desired. In another non-limiting example, a user can keep adding notes by depressing one key repeatedly with latch button 404 selected. For the sake of clarity, many examples throughout this document may refer to adding "notes" to an arpeggiator by a user. However, it should be understood that rests and note ties can be used instead of or in addition to notes, and that arpeggios may be created by a user, by automation, or other method that would be appreciated by one of ordinary skill in the art with the benefit of this disclosure. Furthermore, some embodiments only "grid capture" performance data, which can include velocity data and/or note data identifying whether the "note" is a note (has a pitch), is a rest, or is a chord, as shown in FIG. 21.

Mode selector 406 sets the mode of the arpeggiator. Certain modes may include reset mode, add mode, add temporarily, transpose, gated transpose, and through mode, among other possible implementations. In add mode, a user can add addition notes to an arpeggio in live-mode when latch 404 is selected. For example, if a user plays three notes (C, E, G) and releases the input (e.g., keys), the three notes will play an arpeggio based on the Arc GUI 400 settings (e.g., rate 408, note order 410, variation 420, etc.). Notes played subsequent to the first three notes will be "added" to the arpeggio, such that two additional notes will create a 5-note arpeggio. In reset mode, after the first three notes are latched and released (e.g., user lets go of the keys), the three note arpeggio will play per Arc GUI 400 settings. When the user plays additional notes, the arpeggio is "reset" and the first three notes are replaced with the additional notes. In through mode, after the first three notes are latched and released, the three note arpeggio will play per Arc GUI 400 settings. The user can then play additional notes, such as a melody, to play along with or accompany the repeating arpeggio without affecting the notes of the arpeggio. These modes (and others) and their use cases would be understood by one of ordinary skill in the art with the benefit of this disclosure.

Note order selector 410 can control the melodic trend of the arpeggio. Up button 412 causes the notes of an underlying chord to be played in a repeating arpeggiated pattern of increasing pitch. For example, an A7 chord (A, C#, E, G) may be played in ascending order such as A, C#, E, G, A C#, E, G. Down button 413 causes notes of an underlying chord to be played in a repeating arpeggiated pattern of decreasing pitch. For example, the A7 chord may be played in a descending pattern such as A, G, E, C#, A, G, E. Up/down button 414 causes notes of an underlying chord to be played in alternating increasing and decreasing arpeggiated patterns. For example, the A7 chord may be played in a pattern such as A, C#, E, G, E, C#, A. In button 415 causes notes of an underlying chord to be played as an arpeggio from outside notes going inward. For example, the A7 chord may be played in a pattern such as A, G, C#, E, A, G, C#, E. Random button 416 can cause random patterns of the underlying chord to be played in a randomized fashion (e.g., combinations of upward, downward, in, outward, or other pattern). Free play button 417 causes the arpeggiator to play an arpeggio that matches a pattern played by the user. Any permutation of controlling the note order in an arpeggio can be implemented in Arp GUI 400.

Rate control 408 can control the rate or speed at which a generated arpeggio is played. For example, the notes of the generated arpeggio can be set as whole notes, half notes, quarter notes, eighth notes, sixteenth notes, eighth triplets, or the like. Arpeggio notes set to whole note values may play the underlying arpeggio more slowly than an arpeggio comprised of sixteenth notes. Any suitable method of controlling the rate of an arpeggio is possible (e.g., virtual knobs, faders, MIDI keyboard, etc.), as would be understood by one of ordinary skill in the art.

Variation control 420 controls the manner in which the arpeggio for the underlying chord is played. For example, a first variation pattern may start the arpeggio on a bass note of the underlying chord. The second variation pattern may start the arpeggio on the second note of the underlying chord (e.g., first inversion). The third variation may start the arpeggio on the third note of the underlying chords (e.g., second inversion), and so on. Any algorithm for arpeggiating the underlying chord can be associated with variation control 420, as would be appreciated by one of ordinary skill in the art with the benefit of this disclosure.

Octave Range selector 422 can control the harmonic range of the underlying chord. For example, with an octave range of one, a generated arpeggio may include notes limited to one octave range. With an octave range of two, a generated arpeggio may include notes over two octave ranges, and so on. Any number of octave ranges can be used or assigned to the arpeggio, as would be appreciated by one of ordinary skill in the art.

Control tabs 430 controls content displayed in edit field 440. Control tabs 430 includes a tab designated for pattern control 432, options control 434, keyboard control 436, and controller options 438. Pattern control 432 allows a user to control the content of an arpeggio in real-time, grid-editing, or a combination thereof in edit field 440. In live mode 442, a user can input notes, rests, or note ties in real-time, which appear in note velocity region 450, as further described below. In grid mode 446, a user can input notes, rests, or note ties in note velocity region 450 in a step-wise fashion. By pressing the live-to-grid selector 444, a user can input notes, rests, and note ties in real-time (e.g., with latch 404 and mode selector 406 set to "add" mode) in live-mode and capture or "freeze" the live-played arpeggio in note velocity region 450 for playback, editing, or real-time editing during playback. This transition is shown, e.g., in FIG. 6 and FIG. 7, as further addressed below.

Note position region 460 includes a plurality of positions (461, 462, 463, . . . ) for each note, rest, or note tie in a live-played or grid-captured arpeggio. Position 1 (461) is the first note or rest in the arpeggio, followed by position 2 (462), position 3 (463), and so on. Any number of notes, rests, or note ties can be included in a live-played or grid-captured arpeggio.

Note velocity region 450 depicts the velocities of notes played in the note position region 460 in either live mode 442 or grid mode 446. Notes can vary in velocity and may range from 0 (i.e., a rest) to 127, which is typically a maximum velocity in MIDI. Although the resolution of the velocity is shown to have 127 levels, any resolution of velocity (i.e., number of velocity levels) can be used.

Arpeggio progress bar 480 shows the progress of a played arpeggio. For example, as an arpeggio is played (e.g., see FIG. 7), a bar, slider, or other indicator tracks and highlights the note or rest being played in real-time. For example, progress bar 480 will highlight each note of an 8-note arpeggio in positions 1-8 in succession and in real-time to indicate the current note being played. Any suitable method can be used to indicate a current note or rest being played in an arpeggio in real-time.

Selecting options control 434 populates the edit field with a number of controls (see, e.g., FIG. 14) configured to change aspects of the notes and the way arpeggios are played. For example, note length control 1410 can control how long each note of the arpeggio is played. In some embodiments, a randomizer control 1420 can randomize the note length of each note of the arpeggio by a set amount.

A velocity normalizer 1430 can normalize the velocity of each note of the arpeggio. For example, normalization may be set anywhere from zero percent (i.e., default to velocity values set in pattern control tab 432) to 100 percent (i.e., each note of the arpeggio is set to a uniform programmable value). In some cases, the velocity can also be randomized, crescendoed (1440), or decrescendoed at any predetermined value (e.g., crescendo rate, randomization amount, etc.). Any type of control can be applied to the arpeggio (e.g., swing (1450), cycle length (1460), etc.) as would be appreciated by one of ordinary skill in the art with the benefit of this disclosure.

Selecting the keyboard control tab 436 populates edit field 440 with a depiction of a programmable keyboard (see, e.g., FIG. 15) that can be well suited for live-playing situations. The programmable keyboard can be configured to correspond to a MIDI controller (keyboard). In some settings, a first portion of the keyboard 1520 may be configured to play notes, rests, note ties, etc., to create an arpeggio. A second portion of the keyboard may be configured as a remote controller 1510 where certain keys can be mapped to functions of Arp GUI 400. For example, some keys may toggle start/stop button 402, latch 404, note order selection 410, variation control 420, octave range selection 422, or any other function of Arp GUI 400, allowing a user to more easily edit and/or control aspects of a live-played arpeggio, e.g., on a single MIDI controller without taking her hands off of the keys. In some implementations, notes can be associated with a certain note rate (e.g., ⅛ notes, 1/16 notes, etc.), a certain key (e.g., only notes in C major are played for diatonic harmony), or a certain scale (e.g., chromatic keyboard, etc.).

The controller options tab 438 can be configured to edit or assign controls and/or functions to an external controller (e.g., MIDI controller). For example, each key of a MIDI controller can be assigned to any function associated with Arp GUI 400 (see, e.g., FIG. 16). The embodiments described herein are depicted to explain certain aspects of grid-editing live-played arpeggios. Some Arp GUIs may have more functions, while others may have fewer functions, and the following examples are not intended to be all inclusive. Many variations, components, functions, GUI formats, etc., are possible as would be appreciated by one of ordinary skill in the art with the benefit of this disclosure.

Figure 5:
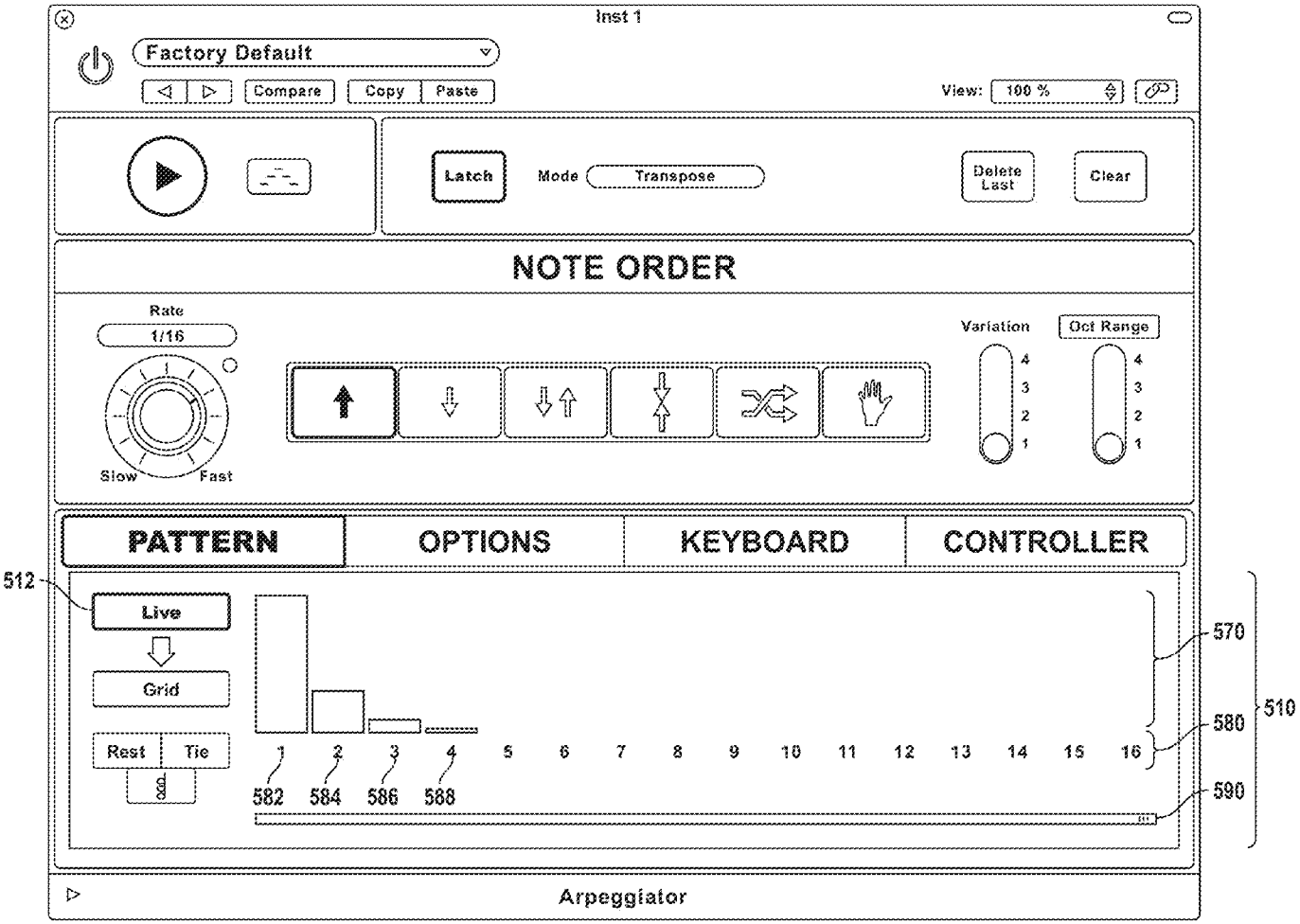
FIG. 5 is a simplified diagram illustrating aspects of a live performance on an arpeggiator interface, according to certain embodiments of the invention.

FIG. 5 is a simplified diagram illustrating aspects of a live performance on an arpeggiator interface 400, according to certain embodiments of the invention. Arp GUI 400 is set to live-mode 442 with start/stop button 402 and latch 404 turned on, mode selector 406 set to "reset," and up button 412 is selected. Note position region 460 indicates that a plurality of 4 notes are played in a rhythmic order and latched (held) as shown in positions 561, 562, 563, and 564 of Arp GUI 400. In some embodiments, only the corresponding performance data (i.e., velocity data, identifiers (note, rest, tie in) are shown in note position region 460. Each note was played at a respective velocity (i.e., note characteristic) with the note at position 561 having a relatively high velocity (e.g., note is played hard) and the note at position 564 having a very low velocity (e.g., note is played soft). In this example, an arpeggio of 4 notes (561-564) is repeatedly played back in an upward melodic trend (up button 412 selected) over a range of one octave (octave range selector 422) with each note of the arpeggio playing in 1/16 notes. Since Arp GUI 400 is in "live mode" (442) with latch 402 enabled, notes 561-564 will remain in play until the keys are released and a subsequent note or plurality of notes are played. A subsequent note or plurality of notes (i.e., arpeggio) will "reset" (i.e., delete) the notes in note position region 460 and replace them with the subsequent plurality of notes. For example, a single note played after the release of notes 561-564 will result in the single note being shown in position 561 with a corresponding velocity in region 550.

Figure 6:
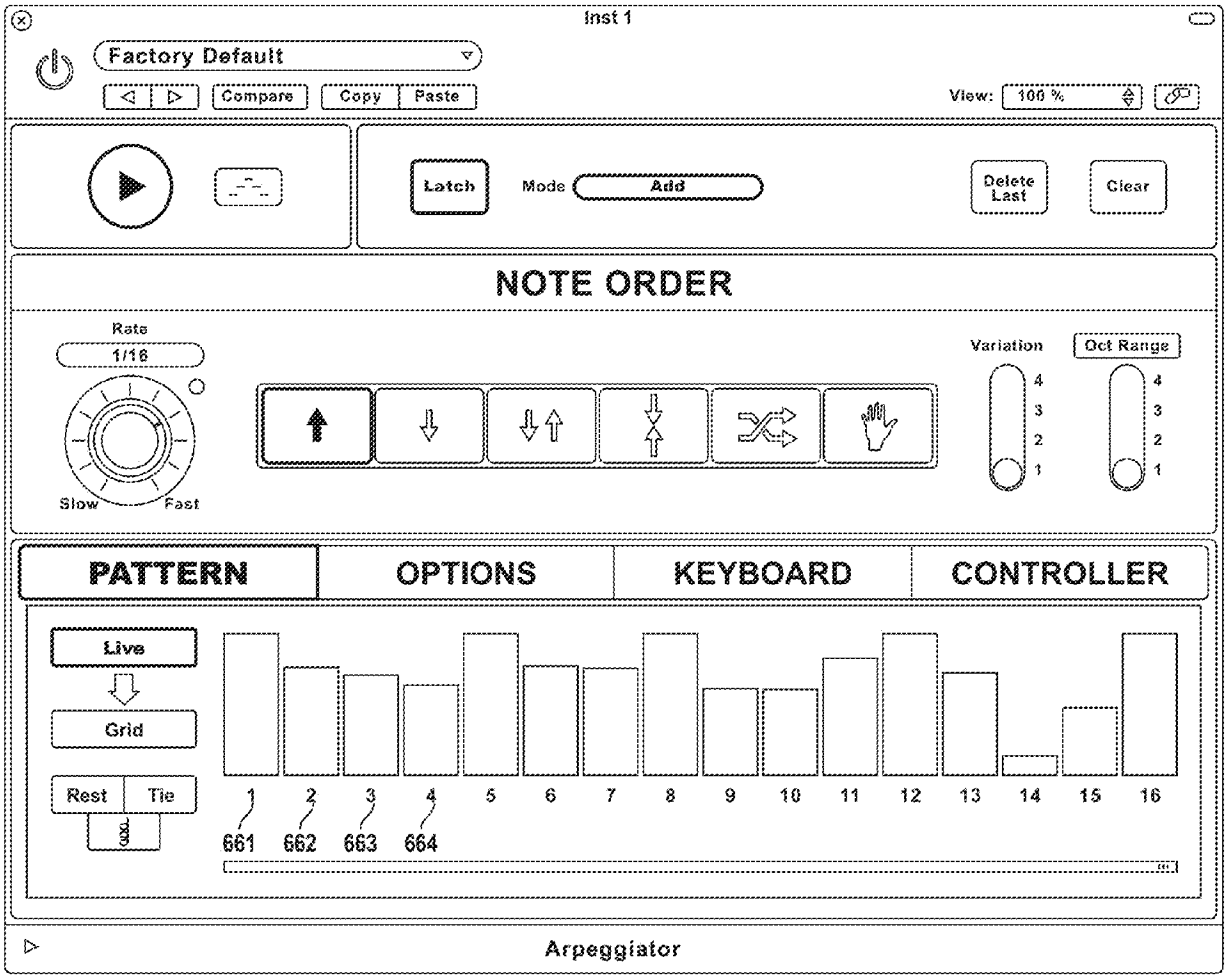
FIG. 6 is a simplified diagram illustrating aspects of a latched live performance on an arpeggiator interface, according to certain embodiments of the invention.

FIG. 6 is a simplified diagram illustrating aspects of a latched live performance on an arpeggiator interface, according to certain embodiments of the invention. Arp GUI 400 is set to live-mode 442 with start/stop 402 and latch 404 turned on, mode selector 406 set to "add," and up button 412 is selected. Note position region 460 indicates that a plurality of 16 notes are played in a rhythmic order with their corresponding performance data being latched (held) as shown, in part, at positions 661, 662, 663, 664 . . . 665, 666 of Arp GUI 400. Each note was played at a respective velocity (i.e., note characteristic) with the note at position 661 having a relatively high velocity (e.g., note is played hard) and the note at position 665 having a very low velocity (e.g., note is played soft). In this example, an arpeggio of 16 notes, including notes 661-666, is repeatedly played back in an upward melodic trend (up button 412 selected) over a range of one octave (octave range selector 422) with each note of the arpeggio playing in 1/16 notes. Since Arp GUI 400 is in "live mode" (442), notes 661-666 will remain in play even after the keys are released. A subsequent note or plurality of notes (i.e., arpeggio) will "add" to the total number of notes in the arpeggio. For example, if all notes 661-666 are released and a subsequent note is played, a $17^{th}$ note will be added to the arpeggio. The arpeggio can be deleted or reset, e.g., by toggling start/stop button 402.

Figure 7:
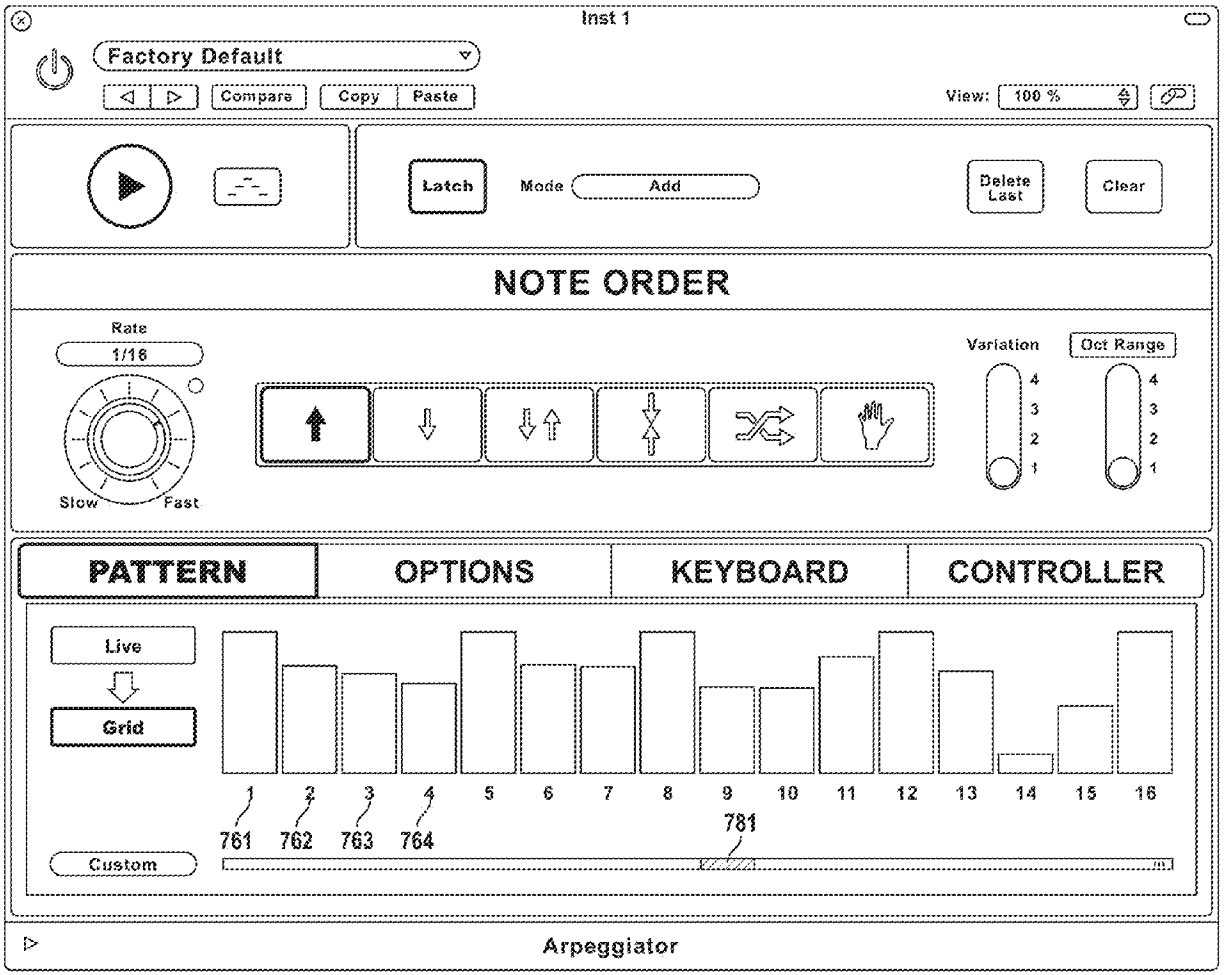
FIG. 7 is a simplified diagram illustrating aspects of grid-captured live performance on an arpeggiator interface, according to certain embodiments of the invention.

FIG. 7 is a simplified diagram illustrating aspects of grid-captured live performance on an arpeggiator interface, according to certain embodiments of the invention. More specifically, FIG. 7 illustrates how aspects of a live-played arpeggio can be grid-captured for subsequent real-time editing. As shown, arp GUI 400 is set to grid capture mode 446 with start/stop 402 and latch 404 turned on, mode selector 406 set to "add," and up button 412 is selected. Note position region 460 indicates that a plurality of 16 notes are played in a rhythmic order with their corresponding performance data being latched (held) as shown in positions 761, 762, 763, 764, 765 of Arp GUI 400. Each note was played at a respective velocity (i.e., note characteristic) with the note at position 761 having a relatively high velocity (e.g., note is played very hard) and the note at position 764 having moderately high velocity (e.g., note is played moderately hard). In this example, a live-played arpeggio of 16 notes that include notes 761-765 is "grid captured" when grid-capture button 444 is selected. In the grid-capture mode, the arpeggio is repeatedly played back in an upward melodic trend (up button 412 selected) over a range of one octave (octave range selector 422) with each note of the arpeggio playing in 1/16 notes. Since Arp GUI 400 is in "grid-capture" (446), the 16 arpeggiated notes will remain in play even after the keys are released. Subsequent note(s) (e.g., a second plurality of notes) will not affect the arpeggio notes or corresponding performance data, as they have been "grid captured." Rather, the second plurality of notes will be played as an arpeggio defined by the grid captured data, i.e., the placement and rhythmic order of the first set of notes and their corresponding performance data. For instance, in the configuration shown in FIG. 7, once the performance data is grid-captured, playing a subsequent triad of notes at maximum velocity (e.g., 127) causes the arpeggiator to play the triad as a repeating pattern of $1/16^{th}$ notes played in an upward melodic trend over one octave and one pattern, with each note corresponding to the performance data (e.g., velocity data) applied to the 16 notes of the grid-capture arpeggio pattern. In some embodiments, the grid-captured arpeggio can be deleted or reset by toggling start/stop button 402 and/or returning to the live-mode.

Figure 8:
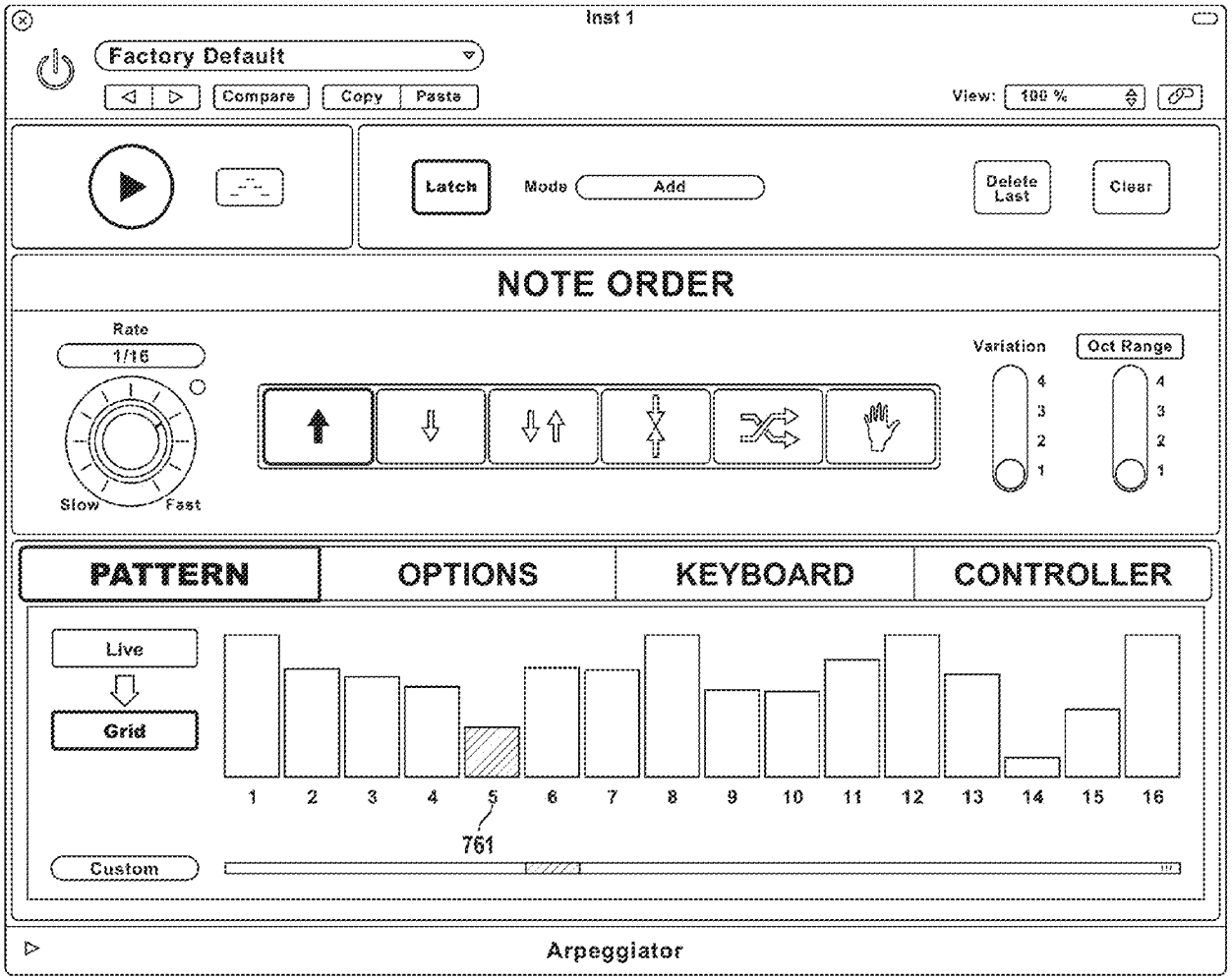
FIG. 8 is a simplified diagram illustrating aspects of grid-editing a live captured arpeggio on an arpeggiator interface, according to certain embodiments of the invention.

FIG. 8 is a simplified diagram illustrating aspects of grid-editing a live captured arpeggio on an arpeggiator interface, according to certain embodiments of the invention. More specifically, FIG. 8 illustrates how a velocity of a note (i.e., performance data) can be edited in a grid-edit mode of operation. As shown, arp GUI 400 is set to grid-capture mode 446 with start/stop 402 and latch 404 turned on, mode selector 406 set to "add," and up button 412 is selected. Note position region 460 indicates that a plurality of 16 notes are played in a rhythmic order with their corresponding performance data being latched (held) as shown in positions 761, 762, 763, 764, 765 of FIG. 7. In this example, a live-played arpeggio of 16 notes that include note 765 have been "grid captured" as described above. In the grid-capture mode, subsequent note (s) (e.g., a second plurality of notes) will not affect the arpeggio notes (i.e., the first plurality of notes) or corresponding performance data, as they are "locked in." In the grid-capture mode, each note along note position region 460 can be edited, added, or deleted. As shown in FIG. 8, the velocity of note 765 is reduced from a high velocity value (shown in FIG. 7), so a lower velocity value, which may cause the note to sound softer (e.g., lower volume, different tonal characteristics, etc.). In certain embodiments, editing can be performed in real-time. Notes can be changed to rests or ties, velocities can be adjusted, etc., in real-time, while the arpeggio pattern is playing. For example, if a user wants a C major chord arpeggio to crescendo from soft to loud, as applied to the control settings of FIG. 8 (e.g., latch 404, mode selector 406, up button 412, etc.), the user can play the notes of C major, causing a repeating arpeggio pattern using the notes C-E-G, and subsequently set the velocity at position 1 (761) to a very low value and progressively increase the velocity of each note thereafter to create a "ramp" of increasing velocity. In some embodiments, editing can be user controlled and/or automated. Furthermore, crescendos can be automated, e.g., by using the crescendo control 1440 shown in FIG. 14.

Figure 9:
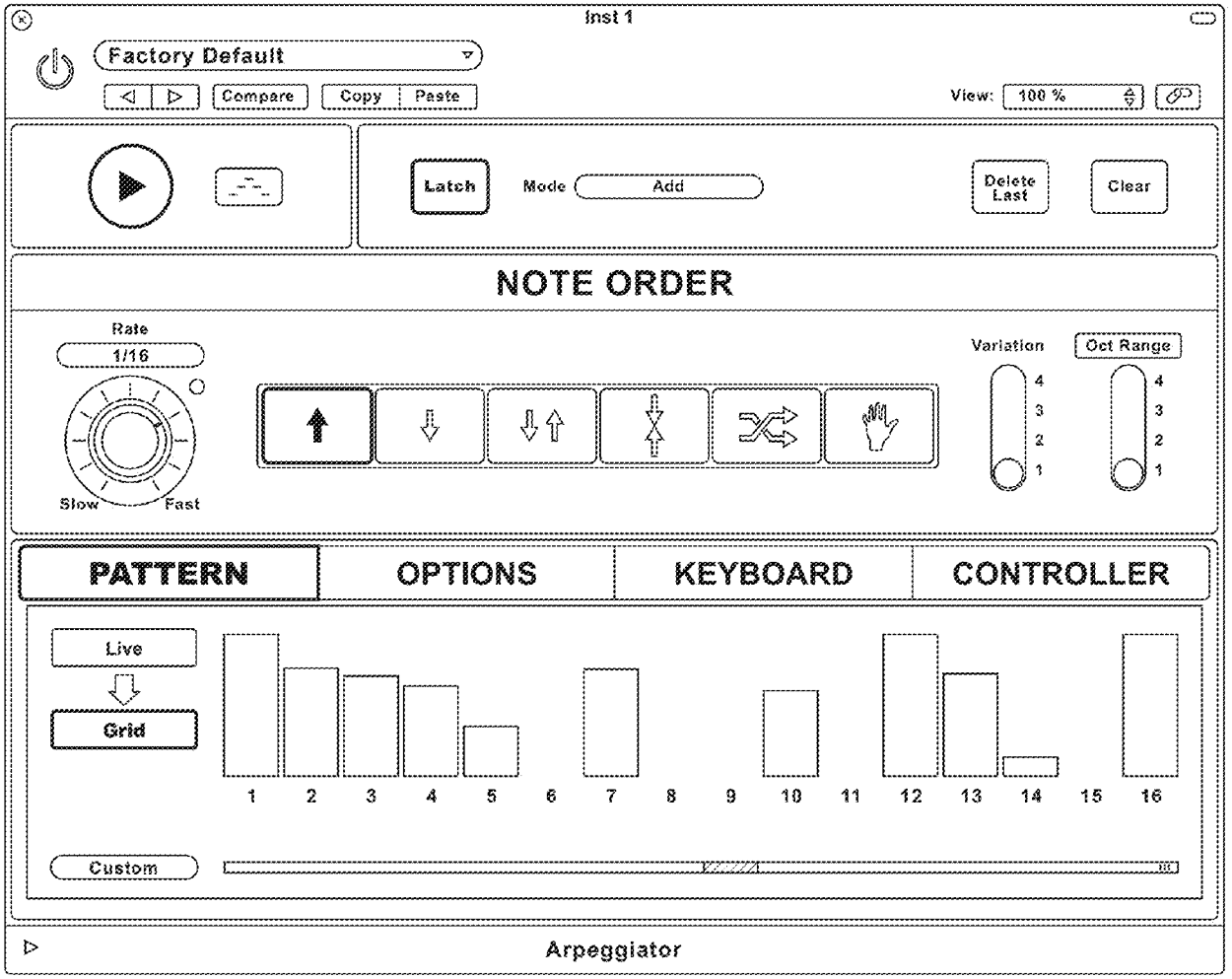
FIG. 9 is a simplified diagram illustrating aspects of grid-editing a live captured arpeggio on an arpeggiator interface, according to certain embodiments of the invention.

FIG. 9 is a simplified diagram illustrating aspects of grid-editing a live captured arpeggio on an arpeggiator interface, according to certain embodiments of the invention. More specifically, FIG. 9 illustrates how rests can be added in the grid-edit mode of operation. As shown, arp GUI 400 is set to grid-capture mode 446 with start/stop 402 and latch 404 turned on, mode selector 406 set to "add," and up button 412 is selected. Note position region 460 indicates that a plurality of 16 notes are played in a rhythmic order with their corresponding performance data being latched (held), similar to the notes shown in positions 761, 762, 763, 764, 765 of FIG. 7. In this example, a live-played arpeggio spanning 16 notes is played and includes changes (e.g., real-time edits) to notes 961, 962, 963, 964, and 965 (i.e., their corresponding performance data), which have been converted to "rests." As described above, rests have a velocity of zero. In some embodiments, rests can be created by reducing a velocity of a note to zero, by toggling the note position indicator under the target note (e.g., position "6" corresponds to note 961), or other suitable method that would be appreciated by one of ordinary skill in the art with the benefit of this disclosure. In some implementations, editing can be user controlled and/or automated in real-time or passively. Editing can be performed using controls on ArpGUI 400, controls on external controllers, such as MIDI keyboards with assignable knobs/controllers configured to edit the various notes, performance data, etc., and the like.

Figure 10:
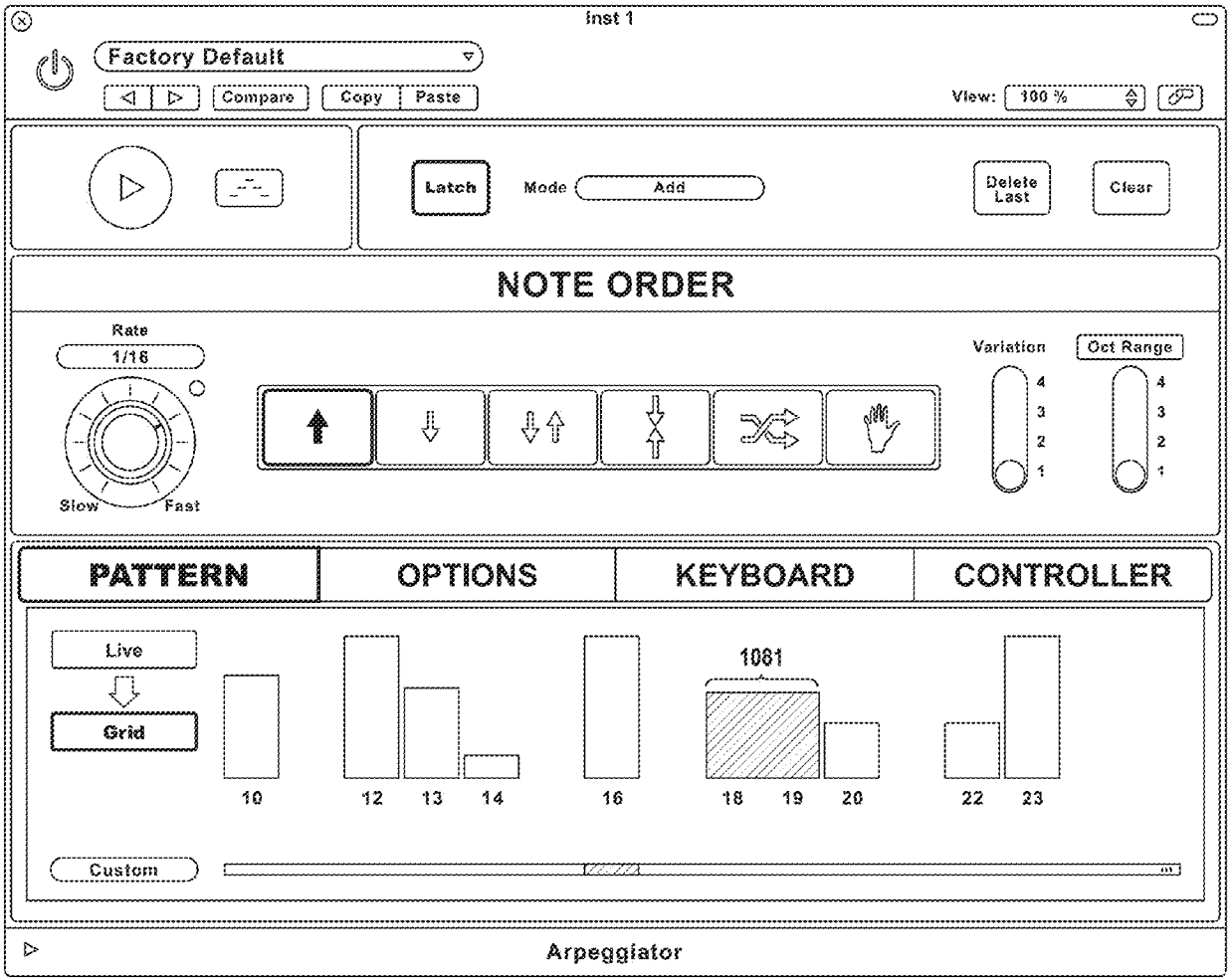
FIG. 10 is a simplified diagram illustrating aspects of grid-editing a live captured arpeggio on an arpeggiator interface, according to certain embodiments of the invention.

FIG. 10 is a simplified diagram illustrating aspects of grid-editing a live captured arpeggio on an arpeggiator interface, according to certain embodiments of the invention. More specifically, FIG. 10 illustrates how a note tie can be added in the grid-edit mode of operation. Note position region 460 shows that a plurality of 16 notes/rests/ties are "grid-captured" and played in a rhythmic order. In some embodiments, a note tie can be created by combining two or more adjacent notes on note position region 460. For example, positions 18 and 19 of note position region 460 include two adjacent notes that are converted to a single note tied together (note tie 1081) such that the note played at position 18 remains in play (i.e., sustained) until the end of position 19. A note tie can span any number of notes. In some embodiments, performance data may be altered for a set of tied notes. For example, a note tie combining three notes may be edited such that the initial note either crescendos or fades out based on a certain decay characteristic. Any desired effect (e.g., echo, delay, distortion, chorus, tone filters, phaser, etc.) can be incorporated in any of the embodiments described within and would be appreciated by one of ordinary skill in the art.

Figure 11:
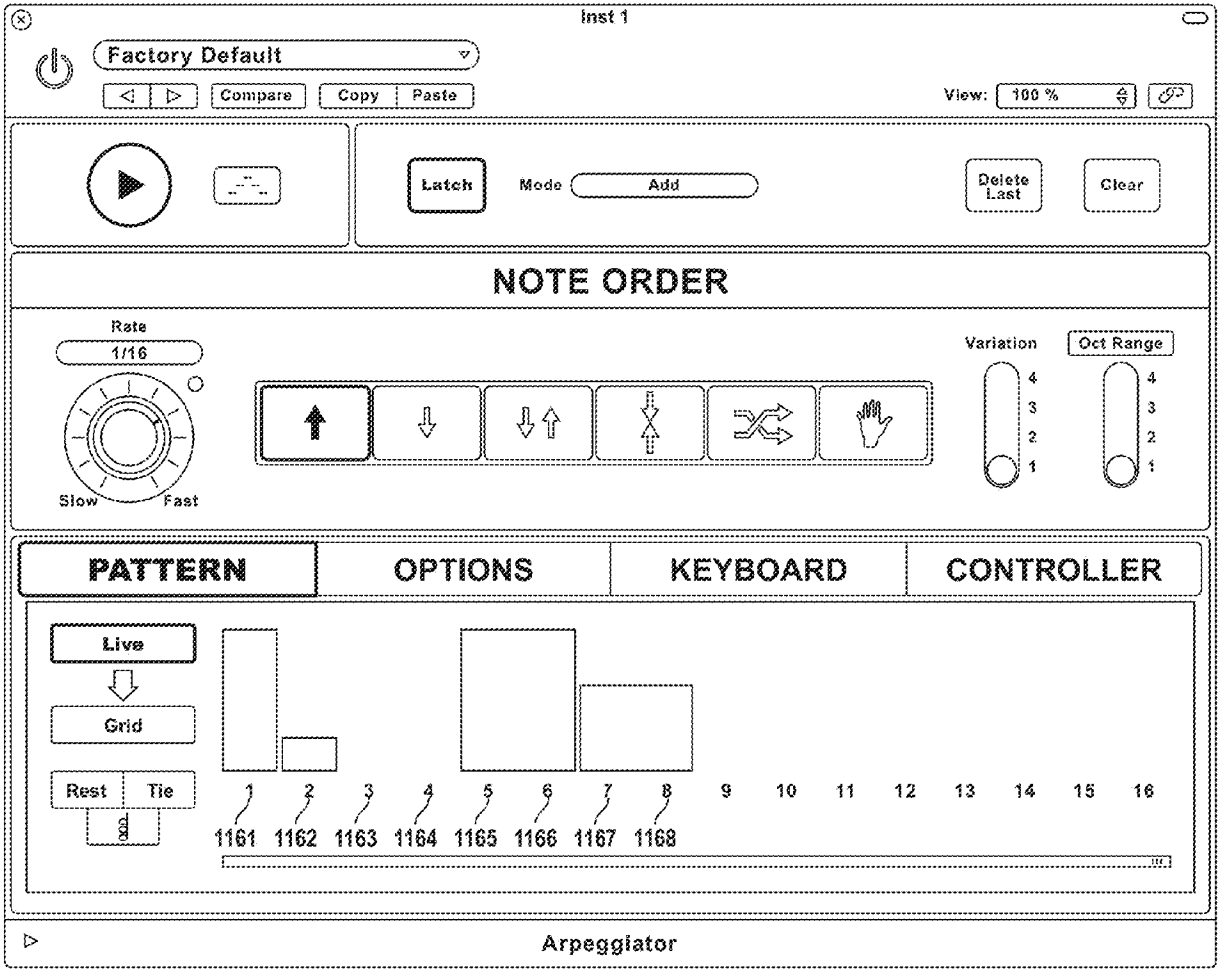
FIG. 11 is a simplified diagram illustrating aspects of a latched live performance on an arpeggiator interface, according to certain embodiments of the invention.

FIG. 11 is a simplified diagram illustrating aspects of a latched live performance on an arpeggiator interface, according to certain embodiments of the invention. More specifically, FIG. 11 illustrates how notes, rests, and note ties can also be implemented during live mode using, e.g., a MIDI keyboard controller with buttons and/or controls configured to enter rests or sustain notes via note ties in real-time. As shown, arp GUI 400 is set to live-mode 442 with start/stop 402 and latch 404 turned on, mode selector 406 set to "add," and up button 412 is selected. Note position region 460 indicates that a four notes and two rests are played in a particular rhythmic order with their corresponding performance data being latched (held) in positions 1161-1168. In the add mode with latch 402 selected, the plurality of notes and rests can be added all at once, one at a time, or a combination there between. For example, notes 1161 and 1162 ($1/16^{th}$ notes) may initially be played and latched, followed by 2 $16^{th}$ note rests 1163, 1164 (e.g., entered by a dedicated key on a MIDI keyboard), and ending with two $1/8^{th}$ notes formed by tying the combination of note 1165 and 1166, and notes 1167 and 1168. As discussed above, additional notes, rests, or note ties will be added to the arpeggio starting at position 9 of note position region 460. The arpeggio can be deleted or reset, e.g., by toggling start/stop button 402.

Figure 12:
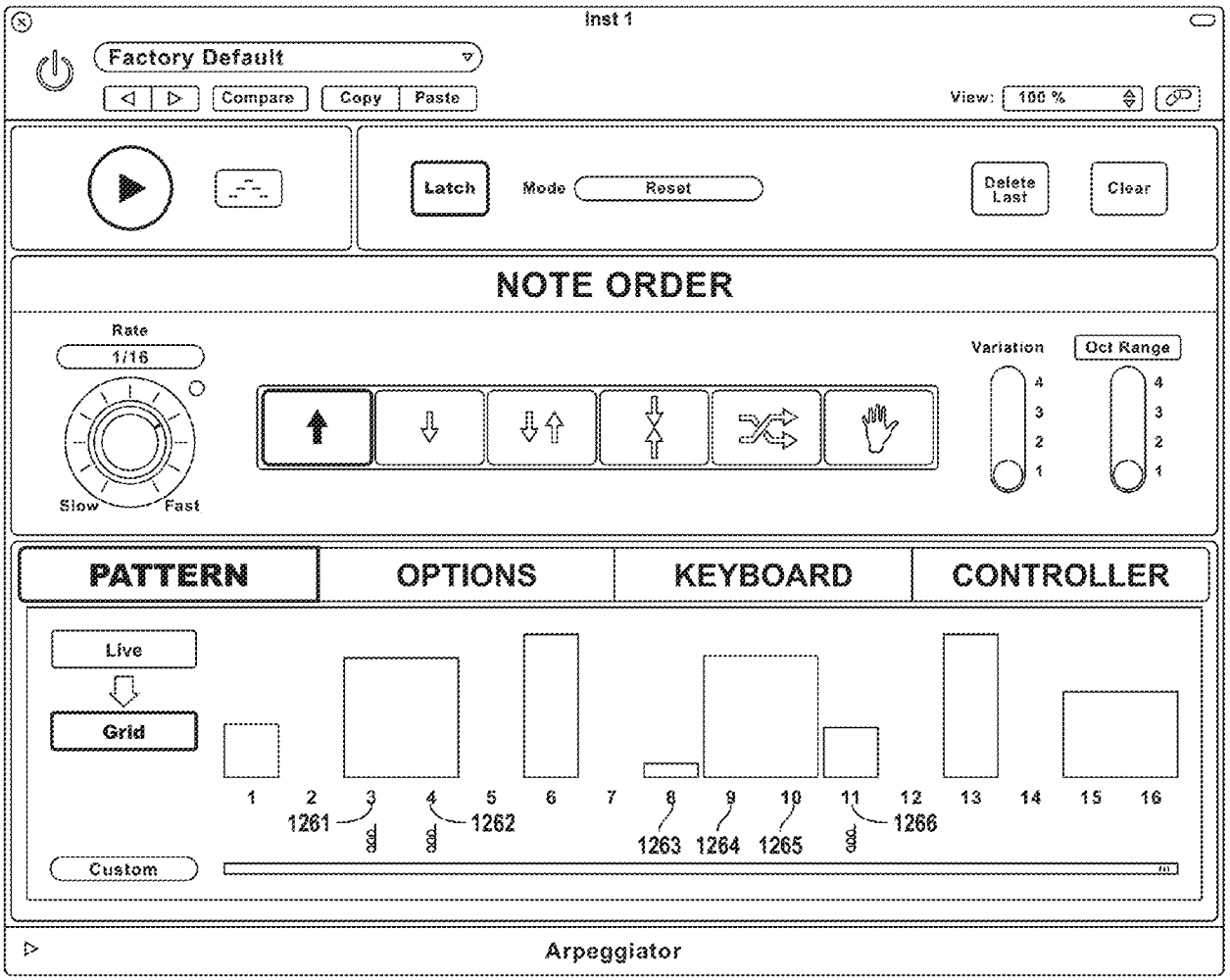
FIG. 12 is a simplified diagram illustrating aspects of grid-editing a live captured arpeggio on an arpeggiator interface, according to certain embodiments of the invention.

FIG. 12 is a simplified diagram illustrating aspects of grid-editing a live captured arpeggio on an arpeggiator interface, according to certain embodiments of the invention. More specifically, FIG. 12 illustrates how certain notes can changed to include chord "stabs," such that two or more notes of a played chord are played at the same time for that particular note position. As shown, arp GUI 400 is set to grid-capture mode 446 with start/stop 402 and latch 404 turned on, mode selector 406 set to "reset," and up button 412 is selected. Note position region 460 indicates that a plurality of notes, rests, and note ties are played in a rhythmic order with their corresponding performance data being latched (held), including notes 1261, 1262, 1263, 1264, 1265 and 1266. In this example, a grid-captured arpeggio is played with notes 1261 and 1262 forming a sustained ⅛$^{th}$ note over positions 3 and 4 of note position region 460 with chord symbols shown underneath. In certain implementations, the sustained note 1261/1262 will sound all of the notes of the arpeggio, or a plural subset thereof, instead of a single note that would typically be played. Note 1266 is also configured to play a chord "stab" as indicated by the chord symbol underneath position 11 of note position region 460.

Figure 13:
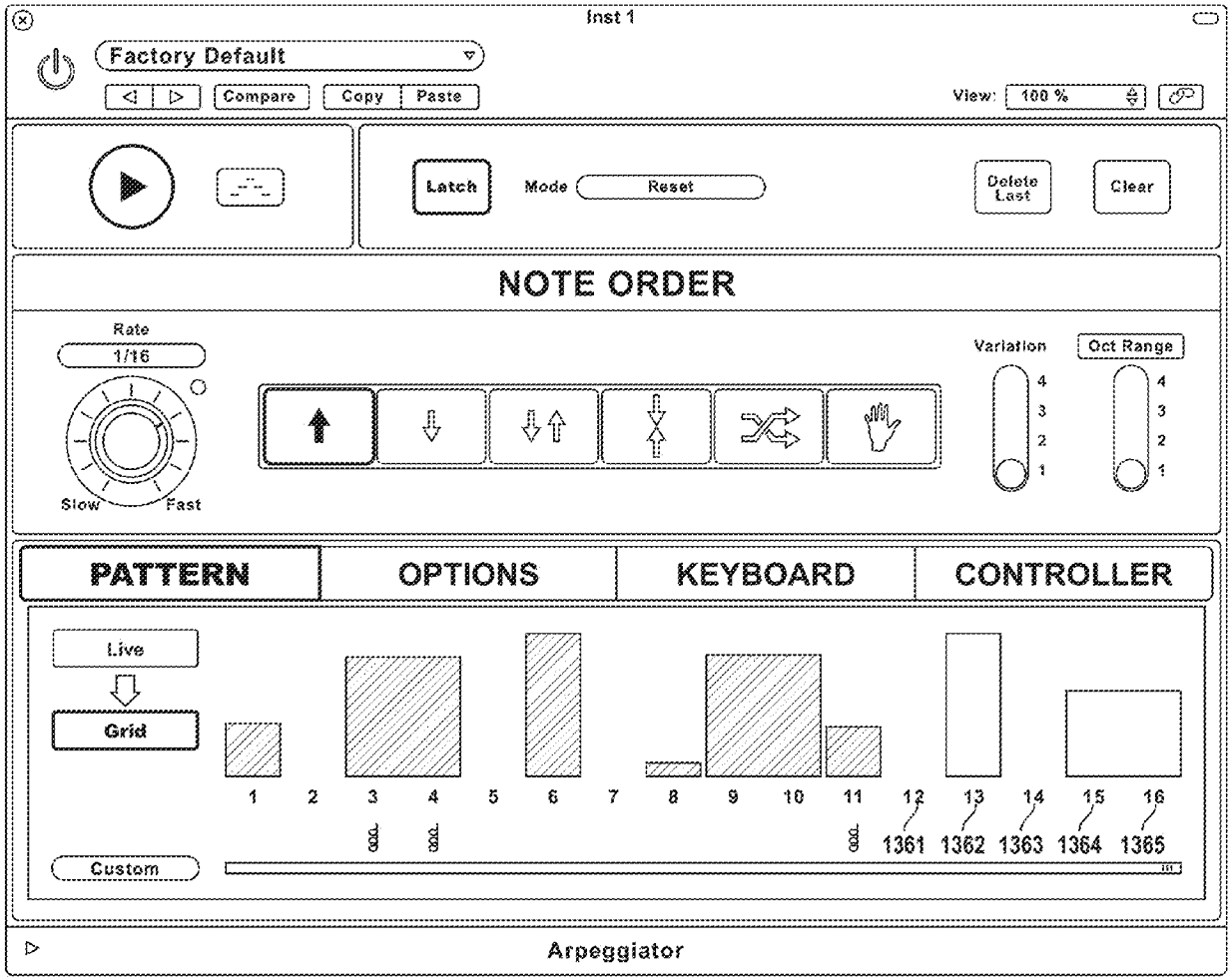
FIG. 13 is a simplified diagram illustrating aspects of grid-editing a live captured arpeggio on an arpeggiator interface, according to certain embodiments of the invention.

FIG. 13 is a simplified diagram illustrating aspects of grid-editing a live captured arpeggio on an arpeggiator interface, according to certain embodiments of the invention. More specifically, FIG. 13 illustrates how notes can be deleted from an arpeggio in real-time. As shown, arp GUI 400 is set to grid-capture mode 446 with start/stop 402 and latch 404 turned on, mode selector 406 set to "reset," and up button 412 is selected. Note position region 460 indicates that a plurality of notes, rests, and note ties are played in a rhythmic order with their corresponding performance data being latched (held), including notes 1361, 1362, 1363, 1364, and 1365, spanning 16 positions over note position region 460. Once the arpeggio is grid-captured, notes can be added or deleted to preference. In FIG. 13, notes 1361-1365 are deselected and are not played during playback of the arpeggio. That is, the notes, rests, and ties corresponding to positions 1-11 of note position region 460 are repeated, while notes 1361-1365 (positions 12-16) are skipped. Some or all of the notes 1361-1365 can be added back into the played arpeggio, they can be edited (e.g., change performance data), or additional notes, rests, or note ties can be added in any desired configuration.

Figure 14:
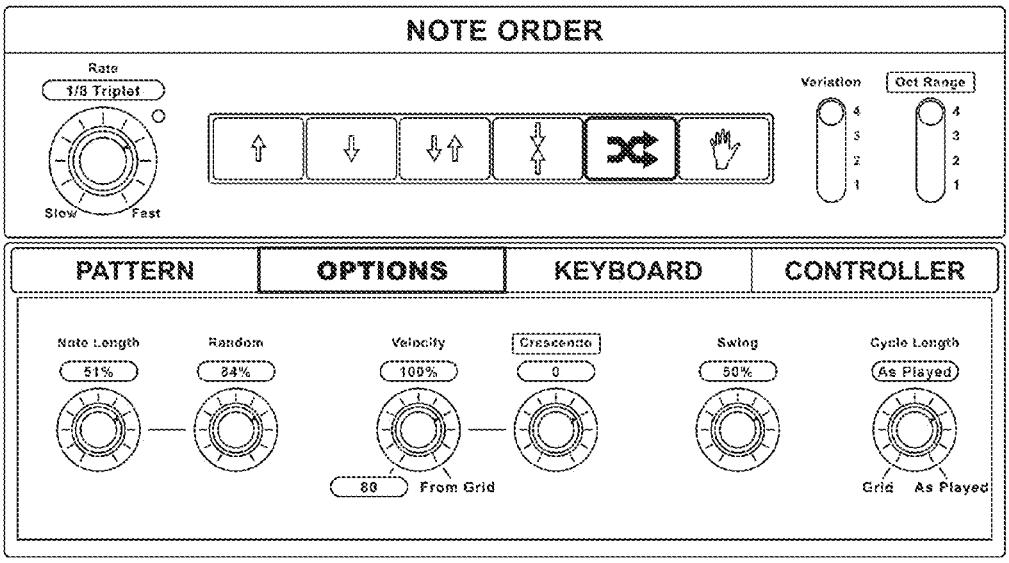
FIG. 14 is a simplified diagram illustrating aspects of an options control menu on an arpeggiator interface, according to certain embodiments of the invention.

FIG. 14 is a simplified diagram illustrating aspects of an options control menu 1400 on an arpeggiator interface, according to certain embodiments of the invention. By selecting options control menu 1400, the edit field is populated with a number of controls configured to change aspects of the notes and the way arpeggios are played. Options control tab 1400 can include a note length control 1410, a randomizer 1420, a velocity control 1430, a crescendo controller 1440, a swing control 1450, and a cycle length controller 1460, among other features. In some embodiments, note length control 1410 can control how long each individual note and/or rest of the arpeggio is played. For example, increasing the note length causes notes to play longer such that very short moments of silence are heard between adjacent notes on note position region 460. Conversely, decreasing the note length causes notes to play for shorter durations, which may sound more "choppy" or staccato. Randomizer 1420 causes the note length to vary according to a random pattern. Increasing or decreasing the randomization can affect the rate of randomization, the range of randomization, and the like.

Velocity control 1430 controls the overall velocity of the arpeggio. In some embodiments, as the velocity is increased, the velocity deviates progressively less from the velocities set in the pattern mode (e.g., 432). As the velocity is decreased, the velocity values for all of the notes in the arpeggio become more uniform and fixed. Crescendo controller 1440 causes the velocities of the arpeggio crescendo at a rate and range dictated by the setting. Increasing crescendo (e.g., increasing positive values) can cause the velocities of the notes to increase at a faster rate and/or an increasing range. Reducing crescendo (decreasing negative values) can cause the velocities of the notes to decrease at an increasing rate and/or an increasing range. In some embodiments, a randomizer control can be applied to the velocity control 1430, as would be appreciated by one of ordinary skill in the art with the benefit of this disclosure.

Swing control 1450 can control an amount of swing to add to the playback of the arpeggio. Cycle length controller 1460 can control how the arpeggio is played and can range from "as played" to the cycle defined in the grid.

Figure 15:
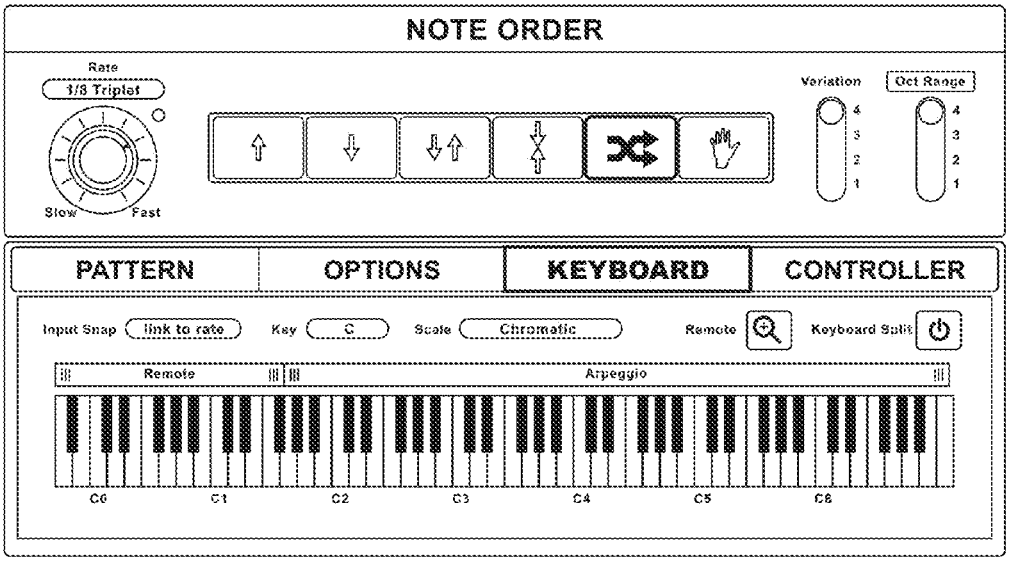
FIG. 15 is a simplified diagram illustrating aspects of a keyboard control menu on an arpeggiator interface, according to certain embodiments of the invention.

FIG. 15 is a simplified diagram illustrating aspects of a keyboard control menu 1500 on an arpeggiator interface, according to certain embodiments of the invention. By selecting keyboard control menu 1500, the edit field is populated with an image of a keyboard that can be well-suited for live-playing. Keyboard control menu can include input snap control 1510, a remote controller setup button 1550, a keyboard split controller 1540, and a keyboard 1505 that can be split into a remote control section 1520 and an arpeggio section 1530. Input Snap control 1510 can link or snap notes (i.e., notes, rests, tied notes) to a rate (e.g., whole note, half note, etc.), a key (C major, D minor), or a scale (e.g., B dim, chromatic, F major). For instance, if input snap control 1510 is set to snap notes to a C major scale, then any set of notes played in an arpeggio (e.g., on arpeggio section 1530) will automatically snap to a note in the C major scale if the particular note is not part of that scale (e.g., C# snaps to C or D). Remote section 1520 of keyboard 1505 can be configured to map keyboard keys to specific functions for quick access during live-playing sessions. For example, keys can be mapped to toggle latch control 402, select a mode of operation (e.g., add, reset, etc.), octave range, variation, note order, changing performance data (e.g., change a note to a rest), options menu controls, or any of the controls described herein in any desired format. The actual key map can be viewed by selecting remote controller setup button 1550 and the keyboard split can be toggled with keyboard split controller 1540. Typically, the virtual keyboard 1505 shown in the keyboard section is controlled by an external MIDI controller, however other control configurations may be used.

Figure 16:
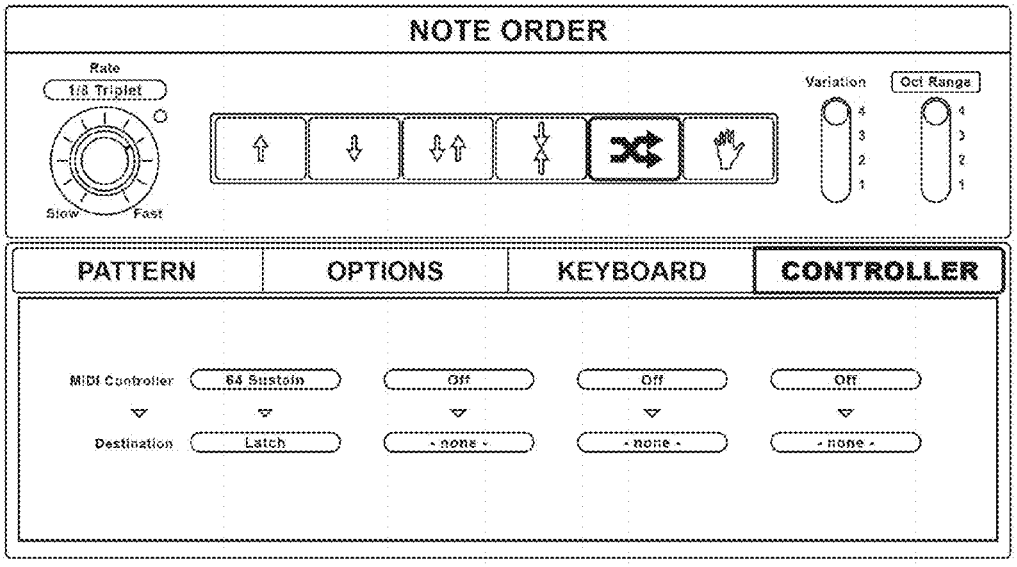
FIG. 16 is a simplified diagram illustrating aspects of a controller options menu on an arpeggiator interface, according to certain embodiments of the invention.

FIG. 16 is a simplified diagram illustrating aspects of a controller options menu 1600 on an arpeggiator interface, according to certain embodiments of the invention. By selecting controller options menu 1600, the edit field is populated with an image of various edit fields configured to edit or assign controls and/or functions to an external controller (e.g., MIDI controller). For example, each key of a MIDI controller can be assigned to any function associated with Arp GUI 400. Controller options menu 1600 can be used to assign the various keys of a MIDI controller to certain functions, as displayed in the keyboard control menu 1500. It should be understood that the embodiments described herein are depicted to explain certain aspects of grid-editing live-played arpeggios. Some Arp GUIs may have more or fewer functions, as the examples provided are not intended to be all inclusive. Many variations, components, functions, GUI formats, etc., are possible as would be appreciated by one of ordinary skill in the art with the benefit of this disclosure.

Figure 17:
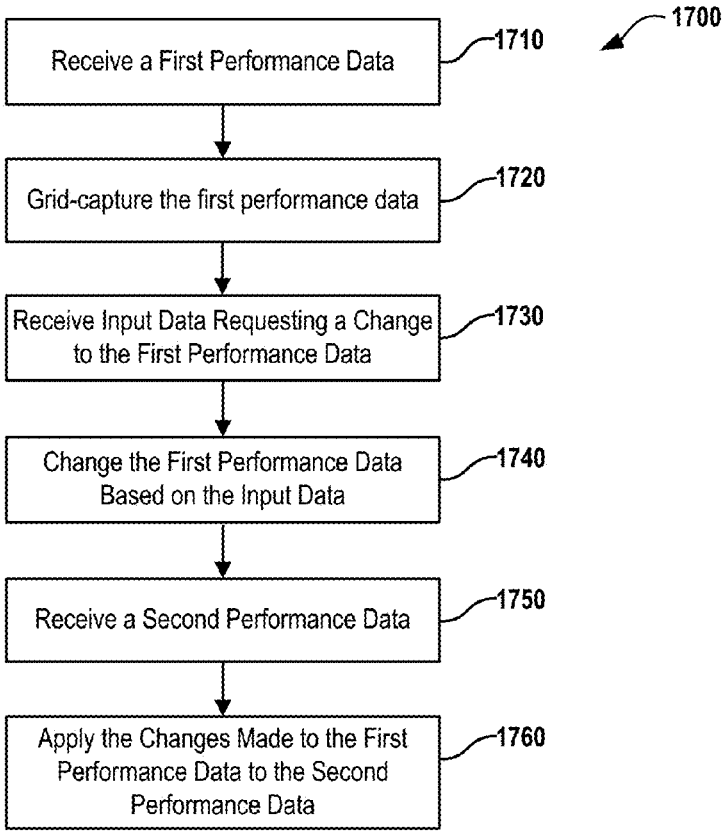
FIG. 17 is a simplified flow diagram illustrating aspects of a method of grid-editing a live-played arpeggio on an arpeggiator interface, according to certain embodiments of the invention.

FIG. 17 is a simplified flow diagram illustrating aspects of a method 1700 of grid editing a live played arpeggio, according to an embodiment of the invention. Method 1700 can be performed by processing logic that may comprise hardware (e.g., circuitry, dedicate logic, etc.), software (which as is run on a general purpose computing system or a dedicated machine), firmware (embedded software), or any combination thereof. In one embodiment, method 1700 is performed by aspects of system 1800 of FIG. 18 including processing unit 1810.

At 1710, method 1700 begins with receiving a first performance data corresponding to a first plurality of notes in a first order. The first plurality of notes can be MIDI-based notes and may form an arpeggio, according to an embodiment of the invention. The first performance data can originate from an external MIDI keyboard, a virtual keyboard, or may be automated and/or previously generated, or can come from any other source as would be appreciated by one of ordinary skill in the art. The performance data can correspond to any number of notes and does not necessarily have to be more than one note. Furthermore, the corresponding first plurality of notes can be "live-played" in real time. For instance, a musician may play the notes in real time, or the notes may be received in real time from a database. The performance data can include velocity data and/or an identifier indicating whether a corresponding note is one of a musical note, a rest, or a note-tie. Performance data can further include the timing of the rhythmic order that the performance data was received (e.g., notes played).

At 1720, the first performance data is "grid-captured", i.e., arranged in a graphical grid pattern in the order that they were received. In some embodiments, grid-capturing can occur when the corresponding notes (e.g., arpeggio) played in "live-mode" 444 are captured in grid-mode 446, which may occur when grid capture button 444 is selected (e.g., directly or through an external MIDI controller). In one non-limiting example, grid-capturing performance data corresponding to an arpeggio is shown and described in the transition between FIGS. 6 and 7. Capturing performance data can include saving performance data in a database for subsequent access and retrieval. In some embodiments, note data (e.g., pitch data) can also be captured, saved, and manipulated similar to the performance data in the other embodiments described herein.

At 1730, method 1700 continues with receiving input data indicating a change to performance data that corresponds to one or more notes of the first plurality of notes. Input data can include data corresponding to changes in velocity data for a particular note of the first plurality of notes. Input data can include data corresponding to changes in a note identifier from a musical note to a rest or tying one note to another note. At 1740, the performance data is changed as dictated by the input data. Some non-limiting examples of changing performance data to one or more notes of the first plurality of notes are shown and described in FIGS. 8-10 and FIG. 12-13. In certain embodiments, the performance data and/or changed performance data can be stored in a database (e.g., database 1825 of system 1800 of FIG. 18).

At 1750, method 1700 continues with receiving second performance data corresponding to a second plurality of notes in a second order. The second plurality of notes can be MIDI-based notes and may form an arpeggio, according to an embodiment of the invention. The corresponding second plurality of notes can originate from an external MIDI keyboard, a virtual keyboard, or may be automated and/or previously generated, or can come from other input source as would be appreciated by one of ordinary skill in the art. The second performance data can correspond to any number of notes and does not necessarily have to be more than one note. Furthermore, the corresponding first plurality of notes can be "live-played" in real time. For instance, a musician may play the notes in real time, or the notes may be received in real time from a database. The second performance data can include velocity data and/or an identifier indicating whether a corresponding note is one of a musical note, a rest, or a note-tie. Performance data can further include the timing of the rhythmic order that the performance data was received (e.g., notes played).

At 1760, method 1700 concludes with applying the changes made to the first performance data to the second performance data. For example, referring back to FIG. 7, the grid captured first performance data shown in edit field 440 includes data (e.g., velocity data) corresponding to 16 notes grid-captured and configured to be played repeatedly in an upward melodic trend over a range of one octave with each note of the corresponding arpeggio playing $1/16^{th}$ notes. The corresponding second plurality of notes are played as defined by the first performance data of the grid, not the second performance data associated with how the second arpeggio is physically played. For instance, in the configuration shown in FIG. 7, once the performance data is grid-captured, playing a subsequent triad of notes at maximum velocity (e.g., 127) causes the arpeggiator to play the triad as a repeating pattern of $1/16^{th}$ notes in an upward melodic trend over one octave and one pattern, with each note having velocity data that corresponds to the velocity data associated with the particular grid-captured note (i.e., the edited performance data of the first plurality of notes), not the velocity that the subsequent note was played. Applying the changes made to the first performance data to the second performance data can executed in real-time.

It should be appreciated that the specific steps illustrated in FIG. 17 provides a particular method of grid editing a live played arpeggio, according to an embodiment of the present invention. Other sequences of steps may also be performed according to alternative embodiments. In certain embodiments, method 1700 may perform the individual steps in a different order, at the same time, or any other sequence for a particular application. Moreover, the individual steps illustrated in FIG. 17 may include multiple sub-steps that may be performed in various sequences as appropriate to the individual step. Furthermore, additional steps may be added or removed depending on the particular applications. One of ordinary skill in the art would recognize and appreciate many variations, modifications, and alternatives of the method.

FIG. 21 is a high level flow diagram illustrating aspects of a system 2100 for operating an arpeggiator, according to certain embodiments of the invention. Many of the grid editing aspects described herein are contained in method steps 2160, 2170, 2172, 2174, and 2176. However, it would be understood by one of ordinary skill in the art with the benefit of this disclosure that there are many ways to implement arpeggiator systems using the grid editing techniques described in herein.

In some implementations, system 2100 is configured to receive MIDI inputs 2104 (e.g., from a keyboard or other MIDI instrument) or from a user interface 2102. At 2110, the MIDI note message is deconstructed. For example, a MIDI note includes pitch information, velocity data, note type data (e.g., rest, tie, note, chord, etc.), and the like. The pitch data is analyzed (step 2120), the note order is processed (2130), and a MIDI message is assembled (2140). MIDI message assembly can include the note number (e.g., pitch), whether the note is on or off, etc. MIDI message assembly can further include velocity, which is further discussed below. The MIDI note message is finally output at MIDI output 2150.

Referring back to the MIDI note message deconstruction (2110), various performance data from the MIDI input is allocated to arpeggiator steps and memory (2160). Performance data can include MIDI velocity data, note data (e.g., is the note an actual note, a rest, or a chord), or other performance data, as would be appreciated by one of ordinary skill in the art. At 2170, the performance data is either live-played 2172 (i.e., not captured) or captured in a step grid 2174. The step grid can be edited by a user 2176, automated, or a combination thereof. The performance data (grid edited or live played) is passed to a note and velocity processing block 2180. The note and velocity processing block 2180 can determines whether the corresponding note will be played based on a note on/off generation block 2190 and corresponding rate input 2192, as well as the user edits of block 2182, which may correspond to the user edits of block 2176. Block 2180 further processes velocity data (i.e., performance data) received from the grid editing section. The output of block 2180 is fed to MIDI message assembly block 2140, as further discussed above.

System Architecture

Figure 18:
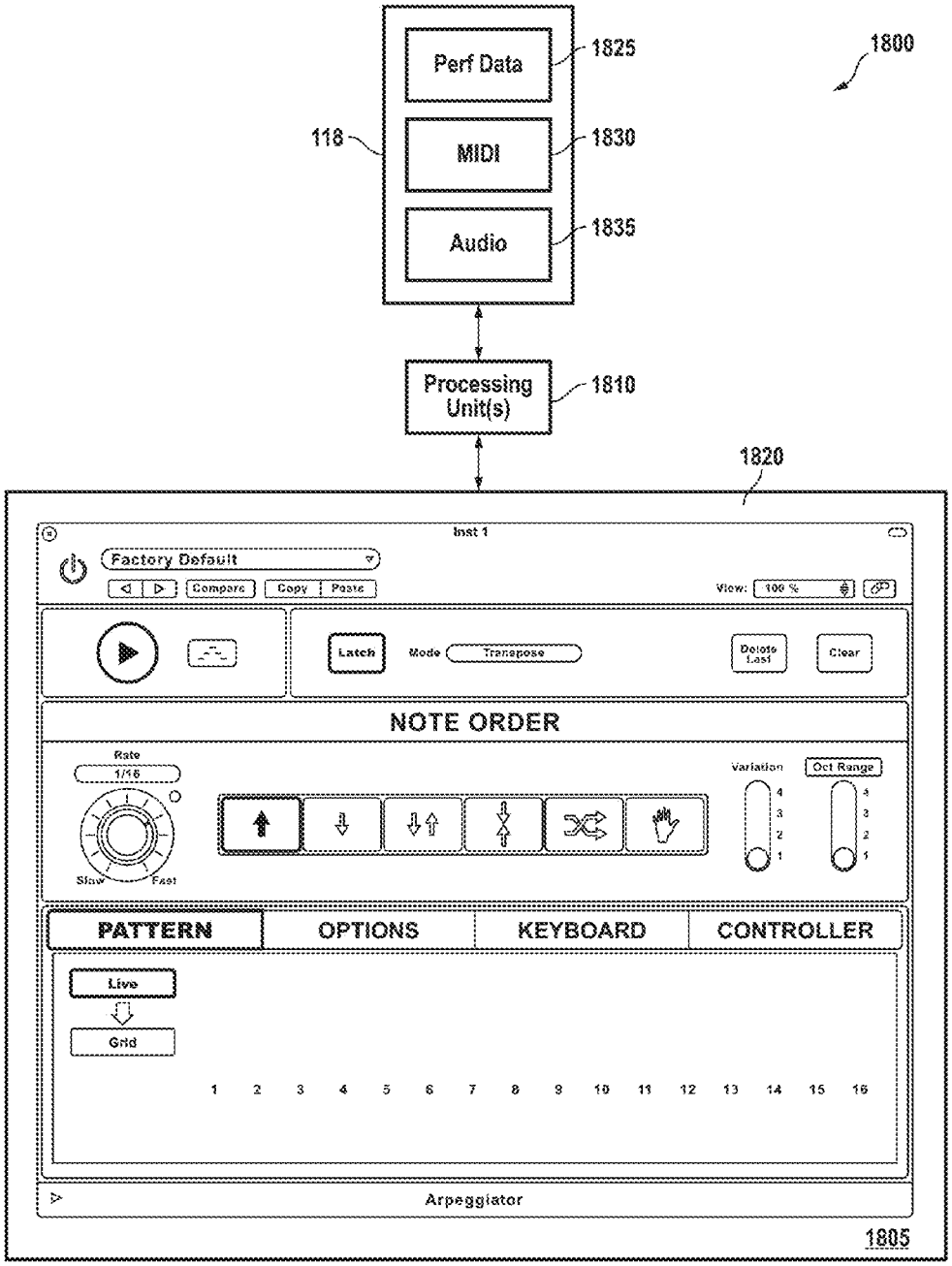
FIG. 18 illustrates an example of a system that can enable a user to compose and create arpeggios with a number of virtual instruments on a software-based music application, according to certain embodiments of the invention.

FIG. 18 illustrates an example of a system 1800 that can enable a user to grid edit a live played arpeggio, according to an embodiment of the invention. System 1800 can be a device that can include multiple subsystems such as a display subsystem 1805, one or more processors or processing units 1810, a storage subsystem 1815, and a communications system 1860. One or more communication paths can be provided to enable one or more of the subsystems to communicate with and exchange data with one another. The various subsystems in FIG. 18 can be implemented in software, hardware, firmware, or combinations thereof. In some embodiments, the software can be stored on a transitory or non-transitory computer readable storage medium and can be executed by one or more processing units. In certain embodiments, storage subsystem 1815 comprises one or more memories for storing the data used or generated by certain embodiments of the present invention and for storing software (e.g., code, computer instructions) that may be executed by one or more processing units 1810.

It should be appreciated that system 1800 as shown in FIG. 18 can include more or fewer components than those shown in FIG. 18, can combine two or more components, or can have a different configuration or arrangement of components. In some embodiments, system 1800 can be a part of a portable computing device, such as a tablet computer, a mobile telephone, a smart phone, a desktop computer, a laptop computer, a kiosk, etc. The system 1800 can operate on an iPhone®, iPad®, iMac®, or the like.

In some embodiments, display subsystem 1805 can provide an interface that allows a user to interact with system 1800. The display subsystem 1805 may be a cathode ray tube (CRT), a flat-panel device such as a liquid crystal display (LCD), a projection device, a touch screen, or the like. In general, use of the term "output device" is intended to include all possible types of devices and mechanisms for outputting information from system 1800. For example, a software keyboard may be displayed using a flat-panel screen. In some embodiments, the display subsystem 1805 can be a touch interface, where the display provides both an interface for outputting information to a user of the device and also as an interface for receiving inputs. In other embodiments, there may be separate input and output subsystems. Through the display subsystem 1805, the user can view and interact with a GUI (Graphical User Interface) 1820 of a system 1800. In some embodiments, display subsystem 1805 can include a touch-sensitive interface (also sometimes referred to as a touch screen) that can both display information to the user and receive inputs from the user. Processing unit(s) 1810 can include one or more processors, each having one or more cores. In some embodiments, processing unit(s) 1810 can execute instructions stored in storage subsystem 1815. System 1800 can further include an audio system to play music (e.g., accompaniments, musical performances, etc.) through one or more audio speakers (not shown).

Communications system 1860 can include various hardware, firmware, and software components to enable electronic communication between multiple computing devices. Communications system 1860 or components thereof can communicate with other devices via Wi-Fi, Bluetooth, infrared, or any other suitable communications protocol that can provide sufficiently fast and reliable data rates to support the real-time jam session functionality described herein.

Storage subsystem 1815 can include various memory units such as a system memory 1830, a read-only memory (ROM) 1840, and a non-volatile storage device 1850. The system memory can be a read-and-write memory device or a volatile read-and-write memory, such as dynamic random access memory. System memory 1830 can store some or all of the instructions and data that the processor(s) or processing unit (s) need at runtime. ROM 1840 can store static data and instructions that are used by processing unit(s) 1810 and other modules of system 1800. Non-volatile storage device 1850 can be a read-and-write capable memory device. Embodiments of the invention can use a mass-storage device (such as a magnetic or optical disk or flash memory) as a permanent storage device. Other embodiments can use a removable storage device (e.g., a floppy disk, a flash drive) as a non-volatile (e.g., permanent) storage device.

Storage subsystem 1815 can store MIDI (Musical Instrument Digital Interface) data relating to notes played on a virtual instrument of system 1800 in MIDI database 1832. A performance data database 1834 can store performance data including velocity data, note identifier data (e.g., note, rest, note tie), rhythmic data, and the like). Further detail regarding system architecture and the auxiliary components thereof (e.g., input/output controllers, memory controllers, etc.) are not discussed in detail so as not to obfuscate the focus on the invention and would be understood by those of ordinary skill in the art.

Figure 19:
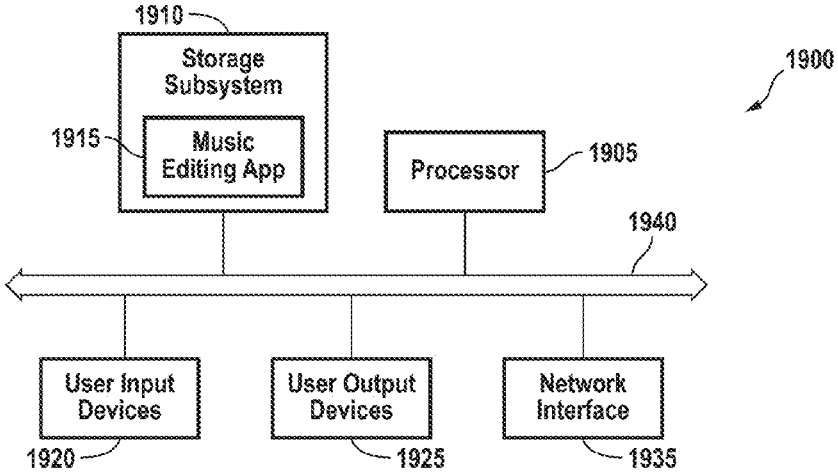
FIG. 19 illustrates an example of a computer system operable to run software configured for grid-editing live played arpeggios, according to certain embodiments of the invention.

FIG. 19 illustrates a computer system 1900 according to an embodiment of the present invention. The user interfaces described herein (e.g., user input block 130) can be implemented within a computer system such as computer system 1900 shown here. Computer system 1900 can be implemented as any of various computing devices, including, e.g., a desktop or laptop computer, tablet computer, smart phone, personal data assistant (PDA), or any other type of computing device, not limited to any particular form factor. Computer system 1900 can include processing unit(s) 1905, storage subsystem 1910, input devices 1920, output devices 1925, network interface 1935, and bus 1940. In some embodiments, system 1900 can be operated in within the framework of Garageband® or Logic®, developed by Apple Computer®.

Processing unit(s) 1905 can include a single processor, which can have one or more cores, or multiple processors. In some embodiments, processing unit(s) 1905 can include a general purpose primary processor as well as one or more special purpose co-processors such as graphics processors, digital signal processors, or the like. In some embodiments, some or all processing units 1905 can be implemented using customized circuits, such as application specific integrated circuits (ASICs) or field programmable gate arrays (FPGAs). In some embodiments, such integrated circuits execute instructions that are stored on the circuit itself. In other embodiments, processing unit(s) 1905 can execute instructions stored in storage subsystem 1910.

Storage subsystem 1910 can include various memory units such as a system memory, a read-only memory (ROM), and a permanent storage device. The ROM can store static data and instructions that are needed by processing unit(s) 1905 and other modules of electronic device 1900. The permanent storage device can be a read-and-write memory device. This permanent storage device can be a non-volatile memory unit that stores instructions and data even when computer system 1900 is powered down. Some embodiments of the invention can use a mass-storage device (such as a magnetic or optical disk or flash memory) as a permanent storage device. Other embodiments can use a removable storage device (e.g., a floppy disk, a flash drive) as a permanent storage device. The system memory can be a read-and-write memory device or a volatile read-and-write memory, such as dynamic random access memory. The system memory can store some or all of the instructions and data that the processor needs at runtime.

Storage subsystem 1910 can include any combination of computer readable storage media including semiconductor memory chips of various types (DRAM, SRAM, SDRAM, flash memory, programmable read-only memory) and so on. Magnetic and/or optical disks can also be used. In some embodiments, storage subsystem 1910 can include removable storage media that can be readable and/or writeable; examples of such media include compact disc (CD), read-only digital versatile disc (e.g., DVD-ROM, dual-layer DVD-ROM), read-only and recordable Blue-Ray® disks, ultra density optical disks, flash memory cards (e.g., SD cards, mini-SD cards, micro-SD cards, etc.), magnetic "floppy" disks, and so on. The computer readable storage media do not include carrier waves and transitory electronic signals passing wirelessly or over wired connections.

In some embodiments, storage subsystem 1910 can store one or more software programs to be executed by processing unit(s) 1905, such as a user interface 1915. As mentioned, "software" can refer to sequences of instructions that, when executed by processing unit(s) 1905 cause computer system 1900 to perform various operations, thus defining one or more specific machine implementations that execute and perform the operations of the software programs. The instructions can be stored as firmware residing in read-only memory and/or applications stored in magnetic storage that can be read into memory for processing by a processor. Software can be implemented as a single program or a collection of separate programs or program modules that interact as desired. Programs and/or data can be stored in non-volatile storage and copied in whole or in part to volatile working memory during program execution. From storage subsystem 1910, processing unit(s) 1905 can retrieve program instructions to execute and data to process in order to execute various operations described herein.

A user interface can be provided by one or more user input devices 1920, display device 1925, and/or and one or more other user output devices (not shown). Input devices 1920 can include any device via which a user can provide signals to computing system 1900; computing system 1900 can interpret the signals as indicative of particular user requests or information. In various embodiments, input devices 1920 can include any or all of a keyboard touch pad, touch screen, mouse or other pointing device, scroll wheel, click wheel, dial, button, switch, keypad, microphone, and so on.

Output devices 1925 can display images generated by electronic device 1900. Output devices 1925 can include various image generation technologies, e.g., a cathode ray tube (CRT), liquid crystal display (LCD), light-emitting diode (LED) including organic light-emitting diodes (OLED), projection system, or the like, together with supporting electronics (e.g., digital-to-analog or analog-to-digital converters, signal processors, or the like), indicator lights, speakers, tactile "display" devices, headphone jacks, printers, and so on. Some embodiments can include a device such as a touchscreen that function as both input and output device.

In some embodiments, output device 1925 can provide a graphical user interface, in which visible image elements in certain areas of output device 1925 are defined as active elements or control elements that the user selects using user input devices 1920. For example, the user can manipulate a user input device to position an on-screen cursor or pointer over the control element, then click a button to indicate the selection. Alternatively, the user can touch the control element (e.g., with a finger or stylus) on a touchscreen device. In some embodiments, the user can speak one or more words associated with the control element (the word can be, e.g., a label on the element or a function associated with the element). In some embodiments, user gestures on a touch-sensitive device can be recognized and interpreted as input commands; these gestures can be but need not be associated with any particular array in output device 1925. Other user interfaces can also be implemented.

Network interface 1935 can provide voice and/or data communication capability for electronic device 1900. In some embodiments, network interface 1935 can include radio frequency (RF) transceiver components for accessing wireless voice and/or data networks (e.g., using cellular telephone technology, advanced data network technology such as 3G, 4G or EDGE, WiFi (IEEE 802.11 family standards, or other mobile communication technologies, or any combination thereof), GPS receiver components, and/or other components. In some embodiments, network interface 1935 can provide wired network connectivity (e.g., Ethernet) in addition to or instead of a wireless interface. Network interface 1935 can be implemented using a combination of hardware (e.g., antennas, modulators/demodulators, encoders/decoders, and other analog and/or digital signal processing circuits) and software components.

Bus 1940 can include various system, peripheral, and chipset buses that communicatively connect the numerous internal devices of electronic device 1900. For example, bus 1940 can communicatively couple processing unit(s) 1905 with storage subsystem 1910. Bus 1940 also connects to input devices 1920 and display 1925. Bus 1940 also couples electronic device 1900 to a network through network interface 1935. In this manner, electronic device 1900 can be a part of a network of multiple computer systems (e.g., a local area network (LAN), a wide area network (WAN), an Intranet, or a network of networks, such as the Internet. Any or all components of electronic device 1900 can be used in conjunction with the invention.

Some embodiments include electronic components, such as microprocessors, storage and memory that store computer program instructions in a computer readable storage medium. Many of the features described in this specification can be implemented as processes that are specified as a set of program instructions encoded on a computer readable storage medium. When these program instructions are executed by one or more processing units, they cause the processing unit (s) to perform various operation indicated in the program instructions. Examples of program instructions or computer code include machine code, such as is produced by a compiler, and files including higher-level code that are executed by a computer, an electronic component, or a microprocessor using an interpreter.

It will be appreciated that computer system 1900 is illustrative and that variations and modifications are possible. Computer system 1900 can have other capabilities not specifically described here (e.g., mobile phone, global positioning system (GPS), power management, one or more cameras, various connection ports for connecting external devices or accessories, etc.). Further, while computer system 1900 is described with reference to particular blocks, it is to be understood that these blocks are defined for convenience of description and are not intended to imply a particular physical arrangement of component parts. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Embodiments of the present invention can be realized in a variety of apparatus including electronic devices implemented using any combination of circuitry and software.

While the invention has been described with respect to specific embodiments, one skilled in the art will recognize that numerous modifications are possible including the displayed representation of the user interface 130 and the configuration of the various elements therein, such as their position, organization, and function, filtering rules and analysis, etc. Thus, although the invention has been described with respect to specific embodiments, it will be appreciated that the invention is intended to cover all modifications and equivalents within the scope of the following claims.

Figure 20:
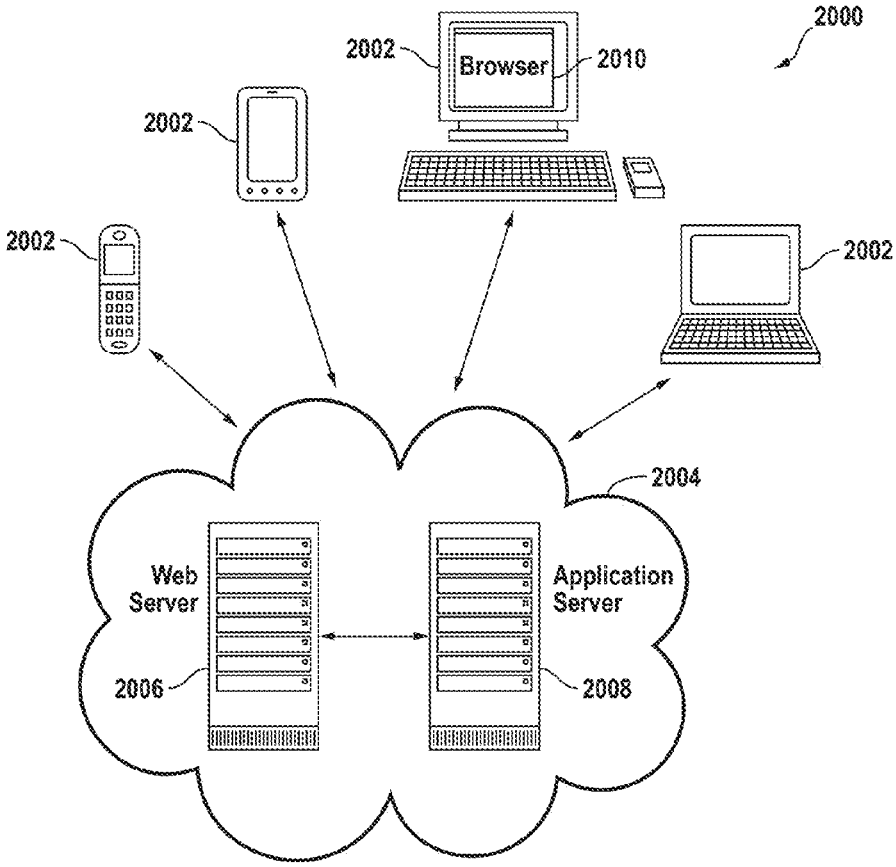
FIG. 20 illustrates a simplified diagram of a distributed system operable to perform aspects of grid-editing live played arpeggios, according to certain embodiments of the invention.

FIG. 20 depicts a simplified diagram of a distributed system 2000 for providing a system and method for generating a rhythmic accompaniment according to some embodiments, according to an embodiment of the invention. In the embodiment depicted in FIG. 20, system 1800 is provided on a server 2004 that is communicatively coupled with a remote client device 2002 via network 2006. Server 2004 may include one or more web servers 2008, application servers 2010, or a combination thereof, or any suitable server based infrastructure.

Network 2006 may include one or more communication networks, which could be the Internet, a local area network (LAN), a wide area network (WAN), a wireless or wired network, an Intranet, a private network, a public network, a switched network, or any other suitable communication network. Network 2006 may include many interconnected systems and communication links including but not restricted to hardwire links, optical links, satellite or other wireless communications links, wave propagation links, or any other ways for communication of information. Various communication protocols may be used to facilitate communication of information via network 2006, including but not restricted to TCP/IP, HTTP protocols, extensible markup language (XML), wireless application protocol (WAP), protocols under development by industry standard organizations, vendor-specific protocols, customized protocols, and others. In the configuration depicted in FIG. 20, aspects of system 1800 may be displayed by client device 2002.

In the configuration depicted in FIG. 20, system 1800 is remotely located from client device 2002. In some embodiments, server 2004 may operate the arpeggiator functions described herein. In some embodiments, the services provided by server 2004 may be offered as web-based or cloud services or under a Software as a Service (SaaS) model.

It should be appreciated that various different distributed system configurations are possible, which may be different from distributed system 2000 depicted in FIG. 20. The embodiment shown in FIG. 20 is thus only one example of system for grid editing a live played arpeggio and is not intended to be limiting.

While the invention has been described with respect to specific embodiments, one skilled in the art will recognize that numerous modifications are possible. Thus, although the invention has been described with respect to specific embodiments, it will be appreciated that the invention is intended to cover all modifications and equivalents within the scope of the following claims.

The above disclosure provides examples and aspects relating to various embodiments within the scope of claims, appended hereto or later added in accordance with applicable law. However, these examples are not limiting as to how any disclosed aspect may be implemented, All the features disclosed in this specification (including any accompanying claims, abstract, and drawings) can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, sixth paragraph. In particular, the use of "step of" in the claims herein is not intended to invoke the provisions of 35 U.S.C. §112, sixth paragraph.

What is claimed is:

1. A computer-implemented method comprising:

receiving, on a computing device, a first set of performance data corresponding to a first plurality of MIDI-based notes, wherein the first set of performance data is received in a first order;

receiving input data requesting a change to the first set of performance data;

changing the first set of performance data based on the input data;

receiving a second set of performance data corresponding to a second plurality of MIDI-based notes, wherein the second set of performance data is received in a second order; and applying the changes made to the first set of performance data to the second set of performance data in real-time.

2. The computer-implemented method of claim 1 further comprising:

storing the changed first set of performance data in a database; and retrieving the changed first set of performance data from the database prior to applying the changed first set of performance data to the second set of performance data.

3. The computer-implemented method of claim 1 further comprising arranging the first set of performance data in a graphical grid pattern in the order received.

4. The computer-implemented method of claim 1 wherein the first set of performance data includes a note velocity.

5. The computer-implemented method of claim 1 wherein the first set of performance data includes an identifier indicating whether a corresponding note is one of a musical note, a rest, or a note-tie.

6. The computer-implemented method of claim 1 wherein the first set of performance data includes a timing of the order received.

7. The computer-implemented method of claim 1 wherein each of the first and second sets of performance data in the graphical grid pattern is configured for real-time step editing.

8. The computer-implemented method of claim 1 wherein the second plurality of MIDI-based notes is a chord, wherein the second plurality of notes is arpeggiated based on the order and changed first set of performance data.

9. A computer-implemented system, comprising:

one or more processors; and one or more non-transitory computer-readable storage mediums containing instructions configured to cause the one or more processors to perform operations including:

receiving, on a computing device, first set of performance data corresponding to a first plurality of MIDI-based notes, wherein the first set of performance data is received in a first order;

receiving input data requesting a change to the first set of performance data;

changing the first performance data based on the input data;

receiving second set of performance data corresponding to a second plurality of MIDI-based notes, wherein the second set of performance data received in a second order; and applying the changes made to the first set of performance data to the second set of performance data in real-time.

10. The system of claim 9 further comprising:

storing the changed first set of performance data in a database; and retrieving the changed first set of performance data from the database prior to applying the changed first set of performance data to the second set of performance data.

11. The system of claim 9 further comprising arranging the first set of performance data in a graphical grid pattern in the order received.

12. The system of claim 9 wherein the first set of performance data includes one or more of a velocity or an identifier, wherein the identifier indicates whether the corresponding note is one of a musical note, a rest, or a note-tie.

13. The system of claim 9 wherein each of the first set of performance data in the graphical grid pattern is configured for real-time step editing.

14. A non-transitory computer-program product, tangibly embodied in a machine-readable non-transitory storage medium, including instructions configured to cause a data processing apparatus to:

receive, on a computing device, first set of performance data corresponding to a first plurality of MIDI-based notes, wherein the first set of performance data is received in a first order;

receive input data requesting a change to the first set of performance data;

change the first set of performance data based on the input data;

receiving a second set of performance data corresponding to a second plurality of MIDI-based notes, wherein the second set of performance data is received in a second order; and apply the changes made to the first set of performance data to the second set of performance data in real-time.

15. The computer-program product of claim 14 further comprising instructions configured to cause a data processing apparatus to:

store the changed first set of performance data in a database; and retrieve the changed first set of performance data from the database prior to applying the changed first set of performance data to the second set of performance data.

16. The computer-program product of claim 14 further comprising instructions configured to cause a data processing apparatus to arrange the first set of performance data in a graphical grid pattern in the order received.

17. The computer-program product of claim 14 wherein the first set of performance data includes one or more of a velocity or an identifier, wherein the identifier indicates whether the corresponding note is one of a musical note, a rest, or a note-tie.

18. The computer-program product of claim 14 wherein the first set of performance data includes a timing of the order received.

19. The computer-program product of claim 14 wherein each of the first and second set of performance data in the graphical grid pattern is configured for real-time step editing.

20. The computer-program product of claim 14 wherein the second plurality of MIDI-based notes is a chord, wherein the second plurality of notes is arpeggiated based on the order and changed first set of performance data.

* * * * *